US006244831B1

(12) United States Patent
Kawabata et al.

(10) Patent No.: US 6,244,831 B1
(45) Date of Patent: Jun. 12, 2001

(54) CONTROL DEVICE FOR VARIABLE DISPLACEMENT PUMP

(75) Inventors: Sachio Kawabata; Kazuhide Matsuda, both of Kobe; Ryuji Sakai, Akash, all of (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 09/373,341

(22) Filed: Aug. 12, 1999

(30) Foreign Application Priority Data

Aug. 12, 1998 (JP) ..... 10-228276
Aug. 12, 1998 (JP) ..... 10-228277

(51) Int. Cl.[7] ..... F04B 49/00
(52) U.S. Cl. ..... 417/213; 417/307; 417/222.2
(58) Field of Search ..... 417/213; 340/608, 340/27.55; 123/357; 303/119.2; 128/204.18, 687; 364/558; 73/118.2; 60/443

(56) References Cited

U.S. PATENT DOCUMENTS 3,935,558 * 1/1976 Miller et al. ..... 340/27 SS
4,823,552 * 4/1989 Ezell et al. ..... 60/443
5,139,026 * 8/1992 Niwa ..... 128/687
5,339,681 * 8/1994 Sekozawa et al. ..... 73/118.2
5,579,244 * 11/1996 Brown ..... 364/558
5,680,109 * 10/1997 Lowe et al. ..... 340/608
5,694,923 * 12/1997 Hete et al. ..... 128/204.18
5,771,861 * 6/1998 Musser et al. ..... 123/357
6,022,086 * 2/2000 Braum ..... 303/119.2

* cited by examiner

*Primary Examiner*—Timothy S. Thorpe
*Assistant Examiner*—Cheryl J. Tyler
(74) *Attorney, Agent, or Firm*—Marshall, O'Toole, Gerstein, Murray & Borun

(57) ABSTRACT

A control device for a variable displacement pump in which a discharge flow rate of a hydraulic operating fluid is varied by changing a variable element comprises a first negative feedback circuit 24 for controlling a pressure of the hydraulic operating fluid fed from the variable displacement pump, a second negative feedback circuit 24*a*, and change-over control means 88. The first negative feedback circuit 24 has first pressure detecting means 13 for detecting the pressure of the hydraulic operating fluid, second pressure detecting means 114 for detecting a vent pressure of an electromagnetic relief valve, and a differential pressure calculation circuit 122 for calculating a difference between the pressures detected by the first and second pressure detecting means 13 and 114. The change-over control means 88 performs change-over control by utilizing a differential pressure signal sent from the differential pressure calculation circuit 122 in such a manner that a relief flow rate of the hydraulic operating fluid is reduced when the pressure detected by the first pressure detecting means 13 is higher than a target pressure.

15 Claims, 10 Drawing Sheets

FIG. 11A
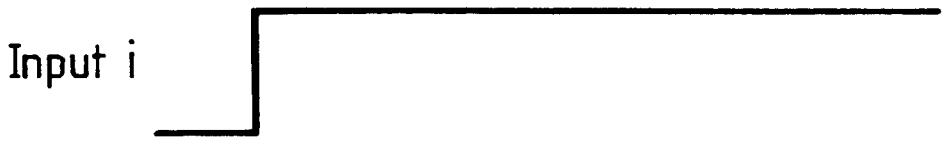
FIG. 11B
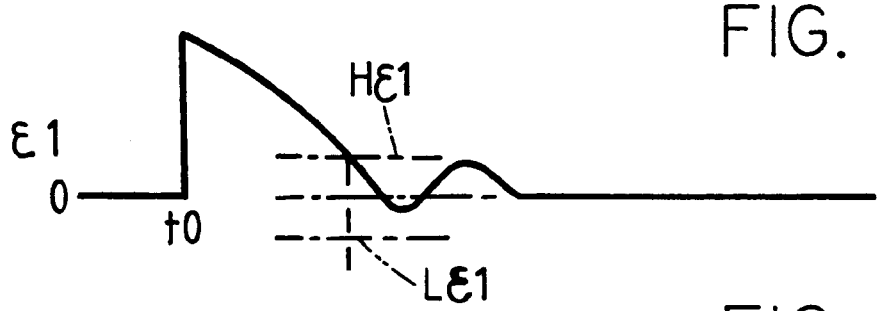
FIG. 11C
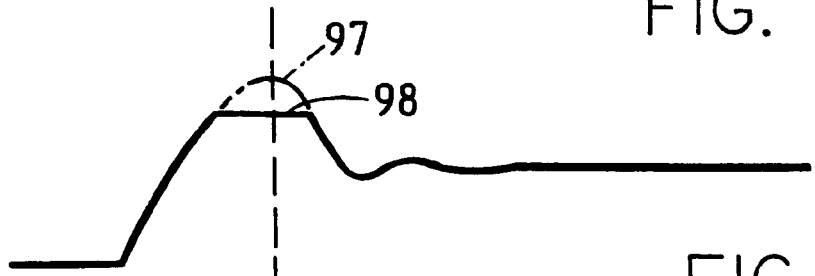
FIG. 11D
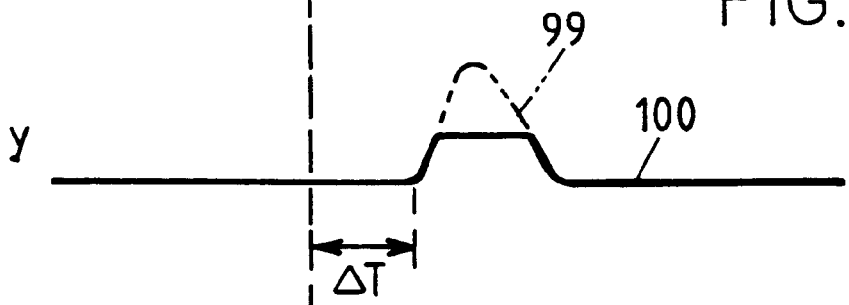
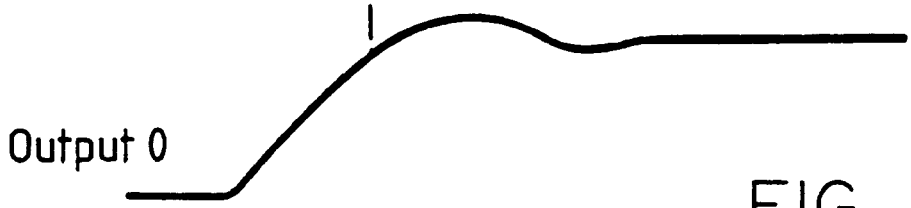
FIG. 11E

CONTROL DEVICE FOR VARIABLE DISPLACEMENT PUMP

BACKGROUND OF THE INVENTION

1. Field of the Invention

The present invention relates to a device for controlling a flow rate of a hydraulic operating fluid fed from a variable displacement pump such as a variable displacement swash plate type axial piston pump.

2. Description of the Related Art

A control device for a variable displacement pump has been used in an injection molding machine or a hydraulic press for performing plastic deformation working on a metal plate or the like, for example. In the injection molding machine, for example, control characteristics having high precision and high response are required in such a manner that a flow rate of a hydraulic operating fluid for driving a hydraulic piston can be controlled according to a flow rate of a molten synthetic resin while keeping a predetermined pressure for a short time of 0.2 second, for example, by the hydraulic piston.

Japanese Unexamined Utility Model Publication No. Hei 1-66483 has disclosed the typical prior art in which a swash plate acting as a variable element in a variable displacement swash plate type axial piston pump is driven by a hydraulic cylinder so that an inclination thereof is controlled, thereby controlling a discharge flow rate of a hydraulic operating fluid corresponding to the inclination and controlling a discharge pressure of the hydraulic operating fluid. In an injection process to be performed in an injection molding machine, it is necessary to cause an injection flow rate to conform to the flow of a synthetic resin while an injection pressure is being kept constant as described above. It may not be possible, however, owing to the shape of a metal mold and a synthetic resin material. In the prior art, it is very difficult to meet such requirements of the injection molding machine to stably control the inclination of the swash plate at a sufficient speed, and response is limited.

In order to solve the above-mentioned problem, there has been proposed a structure in which the flow rate of the hydraulic operating fluid discharged from the pump is kept constant and the pressure of the hydraulic operating fluid is controlled to be constant by means of an electromagnetic relief valve in order to control the pressure. Consequently, it is possible to keep response at a high speed.

With such a structure, however, a relief flow rate of the hydraulic operating fluid bled off from the electromagnetic relief valve is large. Accordingly, there is a problem in that power is wasted.

With such a structure, furthermore, if the pressure of the hydraulic operating fluid is rapidly raised, a speed of a rise in the pressure of the hydraulic operating fluid is increased more than a tilting turn speed of the pump. Consequently, there is a possibility that a high surge pressure might be generated. The pressure of the hydraulic operating fluid is detected, and the detected pressure is converted into an electric signal to control the operation of the electromagnetic relief valve. However, it is impossible to control the pressure of the hydraulic operating fluid with high precision due to a signal delay caused by the pressure detection and a signal delay caused by the conversion into the electric signal and subsequent arithmetic processings.

It is an object of the present invention to provide a control device for a variable displacement pump capable of controlling a relief flow rate obtained from an electromagnetic relief valve with high precision and hopefully capable of reducing the waste of a discharged hydraulic operating fluid as much as possible.

It is another object of the present invention to provide a control device for a variable displacement pump capable of preventing a high surge pressure from being generated.

It is further object of the present invention to provide a control device for a variable displacement pump capable of statically stabilizing the pressure of the hydraulic operating fluid fed from the variable displacement pump in a short time.

It is a further object of the present invention to provide a control device for a variable displacement pump capable of statically stabilizing the flow rate of the hydraulic operating fluid fed from the variable displacement pump in a short time.

SUMMARY OF THE INVENTION

A first aspect of the present invention is directed to a control device for a variable displacement pump for controlling, by an electromagnetic relief valve, a pressure of a hydraulic operating fluid fed from the variable displacement pump capable of varying a flow rate of the discharged hydraulic operating fluid by changing a variable element, the control device comprising a first negative feedback circuit for controlling the pressure of the hydraulic operating fluid fed from the variable displacement pump, the first negative feedback circuit having first pressure detecting means for detecting the pressure of the hydraulic operating fluid fed from the variable displacement pump, second pressure detecting means for detecting a pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in response to an output of the first subtraction circuit in such a manner that the first deviation reaches zero, thereby controlling the electromagnetic relief valve; a second negative feedback circuit having flow rate detecting means for detecting the flow rate of the hydraulic operating fluid fed from the variable displacement pump, a second subtraction circuit for calculating a second deviation of a signal indicative of the detected flow rate which is sent from the flow rate detecting means from an input signal, and a second compensation circuit for changing the variable element in response to an output of the second subtraction circuit in such a manner that the second deviation obtained by the second subtraction circuit reaches zero; target flow rate setting means for setting a target flow rate of the hydraulic operating fluid fed from the variable displacement pump; and change-over control means for calculating a signal indicative of the differential pressure which is sent from the differential pressure calculation circuit and the signal indicative of the detected flow rate which is sent from the flow rate detecting means when the pressure detected by the first pressure detecting means is higher than the target pressure set by the target pressure setting means, thereby giving the calculated signals to the second subtraction circuit in such a manner that a relief flow rate of the hydraulic operating fluid is reduced, and for giving, to the second subtraction circuit, a signal indicative of the target flow rate which is sent from the target flow rate setting means when the pressure detected by the first pressure detecting means is lower than the target pressure set by the target pressure setting means.

According to the present invention, the hydraulic operating fluid fed from the variable displacement pump is controlled by the electromagnetic relief valve. The electromagnetic relief valve is controlled by the first negative feedback circuit. Accordingly, the discharge pressure of the variable displacement pump is kept constant irrespective of the flow rate. In a pressure control state, if the pressure of the hydraulic operating fluid fed from the variable displacement pump which is detected by the first pressure detecting means exceeds the target pressure set by the target pressure setting means, a part of the hydraulic operating fluid fed from the variable displacement pump is subjected to relief through the electromagnetic relief valve. At this time, if the relief flow rate is large, the magnitude of the differential pressure signal is increased by the override characteristics of the electromagnetic relief valve. More specifically, the relief flow rate can be detected by the level of the differential pressure signal even if it is not directly detected. A pump flow rate is reduced in such a manner that the differential pressure signal has a small specific value to control the relief flow rate to have a minimum value. A difference between the pressure detected by the first pressure detecting means, that is, the pressure of the hydraulic operating fluid fed from the variable displacement pump and the pressure detected by the second pressure detecting means, that is, the pilot pressure of the electromagnetic relief valve has no hysteresis, and is substantially proportional to the relief flow rate obtained through the electromagnetic relief valve. Therefore, the relief flow rate obtained from the electromagnetic relief valve can be controlled with high precision by utilizing the difference between the pressure detected by the first pressure detecting means and the pressure detected by the second pressure detecting means.

If the pressure detected by the first pressure detecting means is equal to or lower than the pressure detected by the second pressure detecting means, the signal indicative of the target flow rate set by the target flow rate setting means is given as an input signal to the second subtraction circuit by the operation of the change-over control means to set a flow rate control state and the second negative feedback circuit is operated to have the target flow rate.

A second aspect of the present invention is directed to the control device for a variable displacement pump, further comprising a third arithmetic circuit for calculating a signal indicative of the target pressure which is sent from the target pressure setting means, the pressure correction signal which is sent from the first compensation circuit and the signal indicative of the differential pressure which is sent from the differential pressure calculation circuit.

According to the present invention, the pressure of the hydraulic operating fluid fed from the variable displacement pump is controlled by utilizing the signal indicative of the target pressure which is sent from the target pressure setting means, the pressure correction signal which is sent from the first correction circuit and the signal indicative of the differential pressure which is sent from the differential pressure calculation circuit. In particular, the signal indicative of the differential pressure which is sent from the differential pressure calculation circuit can also detect the surge pressure generated at the time of a change in the capacity of the variable displacement pump or the like. Thus, the surge pressure can be controlled.

A third aspect of the present invention is directed to a control device for a hydraulic operating fluid which controls a pressure of the hydraulic operating fluid by an electromagnetic relief valve, comprising first pressure detecting means for detecting the pressure of the hydraulic operating fluid; second pressure detecting means for detecting a pilot pressure of the electromagnetic relief valve; and a differential pressure calculation circuit for calculating a difference between the pressures detected by the first and second pressure detecting means, a current to be supplied to the electromagnetic relief valve being controlled by using, as one parameter, the difference in the detected pressure which is obtained by the differential pressure calculation circuit so that a relief pressure of the electromagnetic relief valve is controlled.

According to the present invention, a difference between the pressure detected by the first pressure detecting means, that is, the pressure of the hydraulic operating fluid and the pressure detected by the second pressure detecting means, that is, the pilot pressure of the electromagnetic relief valve has no hysteresis, and a surge pressure generated at the time of a change in the capacity of the variable displacement pump or the like can also be detected. Therefore, the pressure of the hydraulic operating fluid can be kept constant with high precision and the surge pressure can be controlled.

A fourth aspect of the present invention is directed to a control device for a variable displacement pump for controlling, by an electromagnetic relief valve, a pressure of a hydraulic operating fluid fed from the variable displacement pump capable of varying a flow rate of the discharged hydraulic operating fluid by changing a variable element, the control device comprising first pressure detecting means for detecting the pressure of the hydraulic operating fluid fed from the variable displacement pump, second pressure detecting means for detecting a pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, command pressure setting means for setting a target command pressure in relation to the target pressure set by the target pressure setting means, a subtraction circuit for calculating a deviation of a signal indicative of the detected pressure which is sent from the first pressure detecting means from the target command pressure set by the command pressure setting means, and a compensation circuit for calculating a pressure correction signal in such a manner that the deviation reaches zero, thereby controlling the electromagnetic relief valve; the command pressure setting means setting the target command pressure based on the pressure detected by the first pressure detecting means, setting, as the target command pressure, a first command pressure which is lower than the target pressure set by the target pressure setting means when the pressure detected by the first pressure detecting means is equal to or lower than a first predetermined pressure which is lower than the target pressure, and setting the target pressure as the target command pressure when the pressure detected by the first pressure detecting means is equal to the target pressure.

According to the present invention, the target pressure of the hydraulic operating fluid fed from the variable displacement pump is set by the target pressure setting means, and the command pressure setting means sets the target command pressure in relation to the target pressure set by the target pressure setting means. In a pressure control state, if the pressure of the hydraulic operating fluid fed from the variable displacement pump exceeds the target command pressure set by the command pressure setting means, the electromagnetic relief valve is opened so that a part of the hydraulic operating fluid fed from the variable displacement pump is subjected to relief through the electromagnetic relief valve. The first pressure detecting means detects the pressure of the hydraulic operating fluid fed from the variable displacement pump, the second pressure detecting means detects the pilot pressure of the electromagnetic relief valve, and the differential pressure calculating means calculates the difference between the pressures detected by the first and second pressure detecting means. The differential pressure obtained by the differential pressure calculating means has no hysteresis, and is substantially proportional to the relief flow rate obtained through the electromagnetic relief valve. Therefore, the relief flow rate obtained from the electromagnetic relief valve can be controlled with high precision by utilizing the difference between the detected pressures. Furthermore, the command pressure setting means sets, as the target command pressure, the first command pressure which is lower than the target pressure when the pressure detected by the first pressure detecting means is equal to or lower than the first predetermined pressure which is lower than the target pressure set by the target pressure setting means, and sets, as the target command pressure, the target pressure when the pressure detected by the first pressure detecting means is equal to the target pressure. Therefore, when a great load does not act, the command pressure setting means sets the first command pressure and the pressure of the hydraulic operating fluid fed from the variable displacement pump is controlled to be the first command pressure. The first command pressure is lower than the target pressure. In such a pressure control state, therefore, even if the pressure of the hydraulic operating fluid is rapidly raised, a peak of a surge pressure is set in the vicinity of the target pressure so that a surge pressure which greatly exceeds the target pressure can be prevented from being generated. When a load pressure, that is, the pressure detected by the first pressure detecting means is the target pressure, the command pressure setting means sets the target pressure as the target command pressure. Therefore, if the pressure of the hydraulic operating fluid fed from the variable displacement pump is raised to reach the target pressure, it is kept at the target pressure. Accordingly, the pressure of the hydraulic operating fluid fed from the variable displacement pump can be kept at the target pressure, and a high surge pressure caused by the rapid rise in the pressure can be prevented from being generated.

A fifth aspect of the present invention is directed to the control device for a variable displacement pump, wherein the command pressure setting means sets the first command pressure as the target command pressure when the pressure detected by the first pressure detecting means is equal to or lower than a first predetermined pressure which is lower than the target pressure, sets the target pressure as the target command pressure when the pressure detected by the first pressure detecting means is equal to the target pressure, and gradually increases the target command pressure to be set as the pressure detected by the first pressure detecting means is raised when the pressure detected by the first pressure detecting means is higher than the first predetermined pressure and is lower than the target pressure.

According to the present invention, the command pressure setting means sets the first command pressure as the target command pressure when the pressure detected by the first pressure detecting means is equal to or lower than the first predetermined pressure, sets the target pressure as the target command pressure when the detected pressure is the target pressure, and gradually increases the target command pressure to be set according to a rise in the detected pressure when the detected pressure is higher than the first predetermined pressure and is lower than the target pressure. Therefore, if a load is increased so that the pressure of the hydraulic operating fluid fed from the variable displacement pump is raised, the target command pressure set by the command pressure setting means is also increased according to the rise in the pressure. Accordingly, the pressure can be changed from the first command pressure into the target pressure while controlling a variation in the pressure of the hydraulic operating fluid, and can be kept at a predetermined target pressure.

A sixth aspect of the present invention is directed to the control device for a variable displacement pump, wherein the command pressure setting means sets the target pressure as the target command pressure when the pressure detected by the first pressure detecting means reaches a second predetermined pressure which is higher than the first predetermined pressure and is lower than the target pressure.

According to the present invention, the command pressure setting means sets the target pressure as the target command pressure if the pressure detected by the first pressure detecting means, that is, the pressure of the hydraulic operating fluid fed from the variable displacement pump reaches the second predetermined pressure which is lower than the target pressure. Therefore, when the detected pressure reaches the target pressure, the target pressure has already been controlled to reach the target command pressure. Accordingly, the hydraulic operating fluid fed from the variable displacement pump can precisely be kept at the target pressure.

A seventh aspect of the present invention is directed to the control device for a variable displacement pump, wherein the command pressure setting means sets the first command pressure as the target command pressure when the pressure detected by the first pressure detecting means is equal to or lower than the first predetermined pressure which is lower than the target pressure, sets the target pressure as the target command pressure when the pressure detected by the first pressure detecting means is equal to or higher than the second predetermined pressure, and gradually increases the target command pressure to be set as the pressure detected by the first pressure detecting means is raised when the pressure detected by the first pressure detecting means is higher than the first predetermined pressure and is lower than the second predetermined pressure.

According to the present invention, the command pressure setting means gradually increases the target command pressure to be set in accordance with the rise in the detected pressure when the pressure detected by the first pressure detecting means is higher than the first predetermined pressure and is lower than the second predetermined pressure. Therefore, when a load is increased so that the pressure of the hydraulic operating fluid fed from the variable displacement pump is raised, the target command pressure set by the command pressure setting means is also increased according to the rise in the pressure. Accordingly, the pressure of the hydraulic operating fluid can be changed from the first command pressure into the target pressure while controlling a variation in the pressure of the hydraulic operating fluid.

An eighth aspect of the present invention is directed to a control device for a variable displacement pump for controlling, by an electromagnetic relief valve, a pressure of a hydraulic operating fluid fed from the variable displacement pump capable of varying a flow rate of the discharged hydraulic operating fluid by changing a variable element, the control device comprising first pressure detecting means for detecting the pressure of the hydraulic operating fluid fed from the variable displacement pump, second pressure detecting means for detecting a pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a subtraction circuit for calculating a deviation of a signal indicative of the detected pressure which is sent from the first pressure detecting means from the target pressure set by the target pressure setting means, and a compensation circuit for calculating a pressure correction signal in relation to an output of the subtraction circuit in such a manner that the deviation reaches zero, thereby controlling the electromagnetic relief valve, the compensation circuit having an integral compensation circuit for performing an integral processing for a signal output from the subtraction circuit, and switch means for transmitting the signal output from the subtraction circuit to the integral compensation circuit and stopping the transmission, the switch means serving to transmit the output signal from the subtraction circuit to the integral compensation circuit after a predetermined time has passed since the signal output from the subtraction circuit got into a predetermined range, thereby starting the integral processing of the integral compensation circuit.

According to the present invention, the target pressure of the hydraulic operating fluid fed from the variable displacement pump is set by the target pressure setting means. If the pressure of the hydraulic operating fluid exceeds the target pressure, the electromagnetic relief valve is opened so that a part of the hydraulic operating fluid fed from the variable displacement pump is subjected to relief through the electromagnetic relief valve. The first pressure detecting means detects the pressure of the hydraulic operating fluid fed from the variable displacement pump, the second pressure detecting means detects the pilot pressure of the electromagnetic relief valve, and the differential pressure calculating means calculates the difference between the pressures detected by the first and second pressure detecting means. The differential pressure obtained by the differential pressure calculating means has no hysteresis and is substantially proportional to a relief flow rate obtained through the electromagnetic relief valve. Therefore, the relief flow rate obtained from the electromagnetic relief valve can be controlled with high precision by utilizing the difference between the detected pressures. Furthermore, the compensation circuit for controlling the electromagnetic relief valve includes the integral compensation circuit for performing an integral processing for the signal output from the subtraction circuit, and the switch means for controlling the transmission of the output signal to the integral compensation circuit. The switch means transmits the output signal to the integral compensation circuit after the predetermined time has passed since the signal output from the subtraction circuit got into the predetermined range. Accordingly, if the pressure of the hydraulic operating fluid approximates to the target pressure, the integral processing is started by the integral compensation circuit of the compensation circuit. The integral processing is started after the predetermined time has passed since the output signal got into the predetermined range, that is, after overshoot or subsequent undershoot has been generated. In general, when the overshoot is generated, the integral value of the integral compensation circuit is increased due to the overshoot and the compensation circuit gives an instruction to greatly lower the pressure of the hydraulic operating fluid. Consequently, the undershoot is generated. When the undershoot is generated, the integral value of the integral compensation circuit is increased due to the undershoot. In this case, the compensation circuit gives an instruction to greatly increase the pressure of the hydraulic operating fluid. Consequently, the overshoot is generated. Thus, when the overshoot and/or the undershoot are/is generated, the convergence of the pressure of the hydraulic operating fluid on the target pressure is delayed and static stability thereof is delayed. On the other hand, as described above, if the time for actuating the integral compensation circuit of the compensation circuit is somewhat delayed, the integral processing is not performed by the integral compensation circuit when the overshoot (and furthermore, the subsequent undershoot) is (are) generated. The integral processing is started when the stability is somewhat obtained after great overshoot (and furthermore, subsequent undershoot) is (are) generated. Accordingly, an increase in the integral value of the compensation circuit can be avoided so that the pressure of the hydraulic operating fluid can be stabilized in a short time.

A ninth aspect of the present invention is directed to a control device for a variable displacement pump for controlling, by an electromagnetic relief valve, a pressure of a hydraulic operating fluid fed from the variable displacement pump capable of varying a flow rate of the discharged hydraulic operating fluid by changing a variable element, the control device comprising a first negative feedback circuit for controlling the pressure of the hydraulic operating fluid fed from the variable displacement pump, the first negative feedback circuit having first pressure detecting means for detecting the pressure of the hydraulic operating fluid fed from the variable displacement pump, second pressure detecting means for detecting a pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in relation to an output of the first subtraction circuit in such a manner that the first deviation reaches zero, thereby controlling the electromagnetic relief valve; a second negative feedback circuit for controlling the flow rate of the hydraulic operating fluid fed from the variable displacement pump, the second negative feedback circuit having flow rate detecting means for detecting the flow rate of the hydraulic operating fluid fed from the variable displacement pump, a second subtraction circuit for calculating a second deviation of a signal indicative of the detected flow rate which is sent from the flow rate detecting means from an input signal, and a second compensation circuit for changing the variable element in relation to an output of the second subtraction circuit in such a manner that the second deviation reaches zero; target flow rate setting means for setting a target flow rate of the hydraulic operating fluid fed from the variable displacement pump; and change-over control means for changing over a signal input to the second subtraction circuit; the change-over control means calculating a signal indicative of the differential pressure which is sent from the differential pressure calculation circuit and the signal indicative of the detected flow rate which is sent from the flow rate detecting means when a difference between the pressure detected by the first pressure detecting means and the target pressure is greater than a predetermined value, thereby giving the calculated output signals as the input signal to the second subtraction circuit in such a manner that a relief flow rate of the hydraulic operating fluid is reduced, and giving, as the input signal, a signal indicative of the target flow rate which is sent from the target flow rate setting means to the second subtraction circuit when the difference between the pressure detected by the first pressure detecting means and the target pressure is equal to or smaller than the predetermined value, the first compensation circuit having a first integral compensation circuit for performing an integral processing for a signal output from the first subtraction circuit, and first switch means for transmitting the signal output from the first subtraction circuit to the first integral compensation circuit and stopping the transmission, the first switch means serving to transmit the output signal from the first subtraction circuit to the first integral compensation circuit after a first time has passed since the signal output from the first subtraction circuit got into a first range, thereby starting the integral processing of the first integral compensation circuit.

According to the present invention, the pressure of the hydraulic operating fluid fed from the variable displacement pump is controlled by the electromagnetic relief valve. The electromagnetic relief valve is controlled by the first negative feedback circuit. Furthermore, the flow rate of the hydraulic operating fluid is controlled by the variable element. The variable element is controlled by the second negative feedback circuit. In a pressure control state, if the difference between the pressure detected by the first detecting means and the target pressure set by the target pressure setting means exceeds the predetermined value, a part of the hydraulic operating fluid fed from the variable displacement pump is subjected to relief through the electromagnetic relief valve. The first pressure detecting means detects the pressure of the hydraulic operating fluid fed from the variable displacement pump, the second pressure detecting means detects the pilot pressure of the electromagnetic relief valve, and the differential pressure calculating means calculates the difference between the pressures detected by the first and second pressure detecting means. The relief flow rate of the electromagnetic relief valve can be controlled with high precision by utilizing the differential pressure. Furthermore, the first compensation circuit for controlling the electromagnetic relief valve includes the first integral compensation circuit for performing an integral processing for the signal output from the first subtraction circuit, and the first switch means for controlling the transmission of the output signal to the first integral compensation circuit. The first switch means transmits the output signal to the first integral compensation circuit after the first time has passed since the signal output from the first subtraction circuit got into the first range. Accordingly, if the pressure of the hydraulic operating fluid approximates to the target pressure, the integral processing is started by the first integral compensation circuit of the first compensation circuit. The integral processing is started after the first time has passed since the output signal got into the first range. Thus, if the time for actuating the first integral compensation circuit is somewhat delayed, the integral processing is not performed by the first integral compensation circuit when the overshoot (and the subsequent undershoot) is (are) generated. The integral processing is started when the stability is somewhat obtained after great overshoot (and subsequent undershoot) is (are) generated. Accordingly, the pressure of the hydraulic operating fluid can be stabilized in a short time.

When the difference between the pressure detected by the first pressure detecting means and the target pressure is equal to or lower than the predetermined value, the control device is brought into a flow rate control state. By the operation of the change-over control means in the flow rate control state, the signal indicative of the target flow rate set by the target flow rate setting means is transmitted as the input signal to the second subtraction circuit and the second negative feedback circuit controls the variable element in such a manner that the flow rate of the hydraulic operating fluid fed from the variable displacement pump reaches the target flow rate.

A tenth aspect of the present invention is directed to the control device for a variable displacement pump, wherein the second compensation circuit has a second integral compensation circuit for performing an integral processing for a signal output from the second subtraction circuit, and second switch means for transmitting the signal output from the second subtraction circuit to the second integral compensation circuit and stopping the transmission, the second switch means serving to transmit the output signal from the second subtraction circuit to the second integral compensation circuit after a second time has passed since the signal output from the second subtraction circuit got into a second range, thereby starting the integral processing of the second integral compensation circuit.

According to the present invention, the second compensation circuit for controlling the variable element includes the second integral compensation circuit for performing an integral processing for the signal output from the second subtraction circuit, and the second switch means for controlling the transmission of the output signal to the second integral compensation circuit. In the flow rate control state, the second switch means transmits the output signal from the second subtraction circuit to the second integral compensation circuit after the second time has passed since the signal output from the second subtraction circuit got into the second range. Accordingly, if the flow rate of the hydraulic operating fluid approximates to the target flow rate, the integral processing is started by the second integral compensation circuit of the second compensation circuit. The integral processing is started after the second time has passed since the output signal got into the second range. Thus, if the time for actuating the second integral compensation circuit is somewhat delayed, the integral processing is not performed by the second integral compensation circuit when the overshoot (and the subsequent undershoot) is (are) generated. The integral processing is started when the stability is somewhat obtained after great overshoot (and subsequent undershoot). Accordingly, the flow rate of the hydraulic operating fluid can be stabilized in a short time.

An eleventh aspect of the present invention is directed to the control device for a variable displacement pump, wherein first and second timer means are provided in relation to the first and second switch means of the first and second compensation circuits, the first timer means starting timing when the signal output from the first subtraction circuit gets into the first range, the integral processing of the first integral compensation circuit being started when the first timer means times the first time, the second timer means starting timing when the signal output from the second subtraction circuit gets into the second range, and the integral processing of the second integral compensation circuit being started when the second timer means times the second time.

According to the present invention, the first and second timer means are provided corresponding to the first and second switch means. Therefore, the first and second times set by the first and second timer means and the times for starting the integral processings of the first and second integral compensation circuits can be delayed. With a comparatively simple structure, the actuation of each of the first and second integral compensation circuits can be delayed.

A twelfth aspect of the present invention is directed to a control device for a variable displacement pump for controlling, by an electromagnetic relief valve, a pressure of a hydraulic operating fluid fed from the variable displacement pump capable of varying a flow rate of the discharged hydraulic operating fluid by changing a variable element, the control device comprising a first negative feedback circuit for controlling the pressure of the hydraulic operating fluid fed from the variable displacement pump, the first negative feedback circuit having first pressure detecting means for detecting the pressure of the hydraulic operating fluid fed from the variable displacement pump, second pressure detecting means for detecting a pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in relation to an output of the first subtraction circuit in such a manner that the first deviation reaches zero, thereby controlling the electromagnetic relief valve; a second negative feedback circuit for controlling the flow rate of the hydraulic operating fluid fed from the variable displacement pump, the second negative feedback circuit having flow rate detecting means for detecting the flow rate of the hydraulic operating fluid fed from the variable displacement pump, a second subtraction circuit for calculating a second deviation of a signal indicative of the detected flow rate which is sent from the flow rate detecting means from an input signal, and a second compensation circuit for changing the variable element in relation to an output of the second subtraction circuit in such a manner that the second deviation reaches zero; target flow rate setting means for setting a target flow rate of the hydraulic operating fluid fed from the variable displacement pump; and change-over control means for changing over a signal input to the second subtraction circuit; the change-over control means calculating a signal indicative of the differential pressure which is sent from the differential pressure calculation circuit and the signal indicative of the detected flow rate which is sent from the flow rate detecting means when a difference between the pressure detected by the first pressure detecting means and the target pressure is greater than a predetermined value, thereby giving the calculated output signals as the input signal to the second subtraction circuit in such a manner that a relief flow rate of the hydraulic operating fluid is reduced, and giving, as the input signal, the signal indicative of the target flow rate which is sent from the target flow rate setting means to the second subtraction circuit when the difference between the pressure detected by the first pressure detecting means and the target pressure is equal to or smaller than the predetermined value, the second compensation circuit having an integral compensation circuit for performing an integral processing for a signal output from the second subtraction circuit, and switch means for transmitting the signal output from the second subtraction circuit to the integral compensation circuit and stopping the transmission, the switch means serving to transmit the output signal from the second subtraction circuit to the integral compensation circuit after a predetermined time has passed since the signal output from the second subtraction circuit got into a predetermined range, thereby starting the integral processing of the integral compensation circuit.

According to the present invention, the pressure of the hydraulic operating fluid fed from the variable displacement pump is controlled by the electromagnetic relief valve, and the electromagnetic relief valve is controlled by the first negative feedback circuit. Furthermore, the flow rate of the hydraulic operating fluid is controlled by the variable element, and the variable element is controlled by the second negative feedback circuit. In the flow rate control state, the switch means transmits the output signal from the second subtraction circuit to the integral compensation circuit after the predetermined time has passed since the signal output from the second subtraction circuit got into the predetermined range. Accordingly, if the flow rate of the hydraulic operating fluid approximates to the target flow rate, the integral processing is started by the integral compensation circuit of the second compensation circuit. The integral processing is started after the predetermined time has passed since the output signal got into the predetermined range. Thus, if the time for actuating the integral compensation circuit is somewhat delayed, the integral processing is not performed by the integral compensation circuit when the overshoot (and the subsequent undershoot) is (are) generated. The integral processing is started when the stability is somewhat obtained after great overshoot (and subsequent undershoot) is (are) generated. Accordingly, the flow rate of the hydraulic operating fluid can be stabilized in a short time.

A thirteenth aspect of the present invention is directed to a control device for a variable displacement pump for controlling, by an electromagnetic relief valve, a pressure of a hydraulic operating fluid fed from the variable displacement pump capable of varying a flow rate of the discharged hydraulic operating fluid by changing a variable element, the control device comprising a first negative feedback circuit for controlling the pressure of the hydraulic operating fluid fed from the variable displacement pump, the first negative feedback circuit having first pressure detecting means for detecting the pressure of the hydraulic operating fluid fed from the variable displacement pump, second pressure detecting means for detecting a pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in response to an output of the first subtraction circuit in such a manner that the first deviation reaches zero, thereby controlling the electromagnetic relief valve; a second negative feedback circuit having flow rate detecting means for detecting the flow rate of the hydraulic operating fluid fed from the variable displacement pump, a second subtraction circuit for calculating a second deviation of a signal indicative of the detected flow rate which is sent from the flow rate detecting means from an input signal, and a second compensation circuit for changing the variable element in response to an output of the second subtraction circuit in such a manner that the second deviation obtained by the second subtraction circuit reaches zero; target flow rate setting means for setting a target flow rate of the hydraulic operating fluid fed from the variable displacement pump; change-over switch means for selectively changing over into a first state in which an operation value of a signal indicative of the differential pressure which is sent from the differential pressure calculation circuit and the signal indicative of the detected flow rate which is sent from the flow rate detecting means is given to the second subtraction circuit and a second state in which a signal indicative of the target flow rate which is sent from the target flow rate setting means is given to the second subtraction circuit; and change-over switch control means for holding the change-over switch means in the first state to reduce a relief flow rate of the hydraulic operating fluid when the pressure detected by the first pressure detecting means is higher than the target pressure set by the target pressure setting means or the differential pressure signal sent from the differential pressure calculation circuit is greater than a predetermined value, and for holding the change-over switch means in the second state when the pressure detected by the first pressure detecting means is lower than the target pressure set by the target pressure setting means and the differential pressure signal sent from the differential pressure calculation circuit is smaller than the predetermined value.

According to the present invention, the hydraulic operating fluid fed from the variable displacement pump is controlled by the electromagnetic relief valve. The electromagnetic relief valve is controlled by the first negative feedback circuit. Accordingly, the discharge pressure of the variable displacement pump is kept constant irrespective of the flow rate. In the pressure control state, if the pressure of the hydraulic operating fluid fed from the variable displacement pump which is detected by the first pressure detecting means exceeds the target pressure set by the target pressure setting means, a part of the hydraulic operating fluid fed from the variable displacement pump is subjected to relief through the electromagnetic relief valve. At this time, if the relief flow rate is large, the magnitude of the differential pressure signal is increased by the override characteristics of the electromagnetic relief valve. More specifically, the relief flow rate can be detected by the level of the differential pressure signal even if it is not directly detected. A pump flow rate is reduced in such a manner that the differential pressure signal has a small specific value to control the relief flow rate to have a minimum value. A difference between the pressure detected by the first pressure detecting means, that is, the pressure of the hydraulic operating fluid fed from the variable displacement pump and the pressure detected by the second pressure detecting means, that is, the pilot pressure of the electromagnetic relief valve has no hysteresis, and is substantially proportional to the relief flow rate obtained through the electromagnetic relief valve. Therefore, the relief flow rate obtained from the electromagnetic relief valve can be controlled with high precision by utilizing the difference between the pressure detected by the first pressure detecting means and the pressure detected by the second pressure detecting means.

If the pressure detected by the first pressure detecting means is higher than the pressure set by the target pressure setting means or the differential pressure signal sent from the differential pressure calculation circuit is greater than the predetermined value, the control device is changed over from the flow rate control state into the pressure control state. In the pressure control state, the pressure control is performed in such manner that the pressure detected by the first pressure detecting means reaches the target pressure set by the target pressure setting means. Thus, even if the pressure detected by the first pressure detecting means doesn't reach the pressure set by the target pressure setting means, the pressure control is performed when the difference between the pressure detected by the first pressure detecting means and the pressure detected by the second pressure detecting means is greater than the predetermined value. Therefore, even if the pressure of the hydraulic operating fluid is rapidly raised, it is possible to prevent a high surge pressure from being generated.

A fourteenth aspect of the present invention is directed to the control device for a variable displacement pump, further comprising a first low-pass filter for processing the signal indicative of the detected pressure which is sent from the first pressure detecting means and a second low-pass filter for processing a signal indicative of the detected pressure which is sent from the second pressure detecting means, a cut-off frequency of the second low-pass filter being set lower than that of the first low-pass filter.

According to the present invention, a detection signal sent from the first pressure detecting means is transmitted to the differential pressure calculation circuit through the first low-pass filter, and a detection signal sent from the second pressure detecting means is transmitted to the differential pressure calculation circuit through the second low-pass filter. Therefore, noise components contained in each detection signal can be removed. The cut-off frequency of the second low-pass filter is set lower than that of the first low-pass filter. Therefore, the detection signal sent from the second pressure detecting means is transmitted to the differential pressure calculation circuit with a greater time delay than in the detection signal sent from the first pressure detecting means. Therefore, a value obtained by the calculation of the differential pressure calculation circuit, that is, the difference between the pressure detected by the first pressure detecting means and the pressure detected by the second pressure detecting means is closer to an actual differential pressure. Thus, the pressure control of the hydraulic operating fluid can be performed with higher precision.

A fifteenth aspect of the present invention is directed to a control device for a variable displacement pump for controlling, by an electromagnetic relief valve, a pressure of a hydraulic operating fluid fed from the variable displacement pump capable of varying a flow rate of the discharged hydraulic operating fluid by changing a variable element, the control device comprising a negative feedback circuit for controlling the pressure of the hydraulic operating fluid fed from the variable displacement pump in a pressure control state in which the pressure of the hydraulic operating fluid is to be controlled, the negative feedback circuit having first pressure detecting means for detecting the pressure of the hydraulic operating fluid fed from the variable displacement pump, second pressure detecting means for detecting a pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in response to an output of the first subtraction circuit in such a manner that the first deviation reaches zero, thereby controlling the electromagnetic relief valve; the control device further comprising a first low-pass filter for processing the signal indicative of the detected pressure which is sent from the first pressure detecting means and a second low-pass filter for processing a signal indicative of the detected pressure which is sent from the second pressure detecting means, a cut-off frequency of the second low-pass filter being set lower than that of the first low-pass filter.

According to the present invention, the negative feedback circuit for controlling the pressure of the hydraulic operating fluid in the pressure control state has the same structure as in the thirteenth aspect of the present invention. Accordingly, the electromagnetic relief valve is controlled so that the pressure of the hydraulic operating fluid fed from the variable displacement pump can be kept constant. In the same manner as in the fourteenth aspect of the present invention, the first and second low-pass filters are provided corresponding to the first and second pressure detecting means. Therefore, the pressure of the hydraulic operating fluid can be controlled with higher precision.

The above-mentioned "signal operation" means an operation of data value represented by the signal and "the signal gets into the range" means "a data value represented by the signal is present within the range", which will be hereinafter used with the same meaning respectively. The operation includes a differential operation, an integral operation and the like as well as addition, subtraction, multiplication and division.

BRIEF DESCRIPTION OF THE DRAWINGS

FIGS. 11(A) to 11(E) are charts illustrating the operation of the control device shown in FIG. 9;

DESCRIPTION OF THE PREFERRED EMBODIMENTS

First of all, a first embodiment of the present invention will be described with reference to FIGS. 1 to 6. A relief flow rate obtained from an electromagnetic relief valve can be controlled with high precision by a control device for a variable displacement pump according to the present embodiment. In addition, the waste of a discharged hydraulic operating fluid can be reduced as much as possible.

Figure 1:
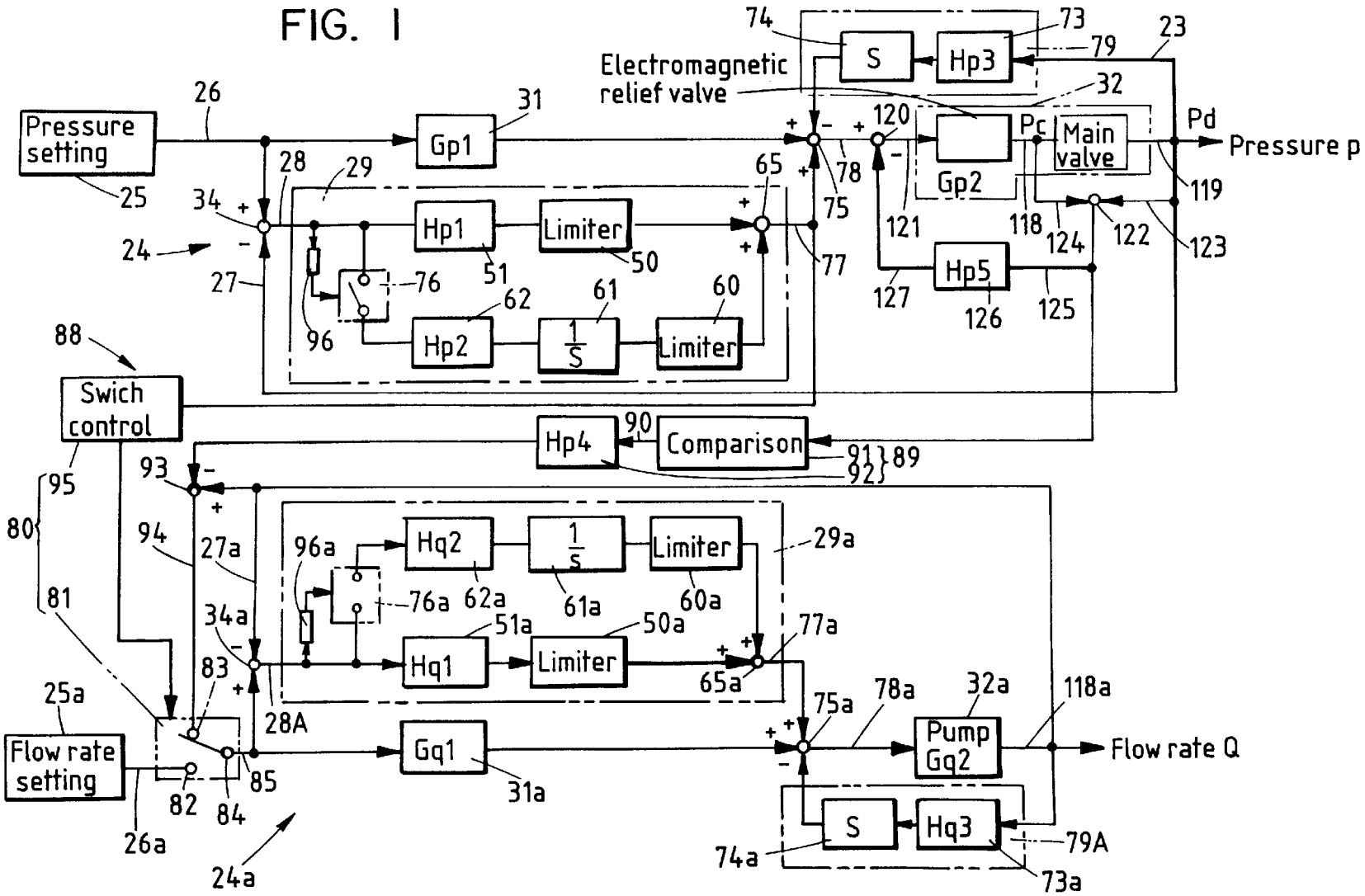
FIG. 1 is a block diagram showing the whole structure of a control device for a variable displacement pump according to a first embodiment of the present invention.
Figure 2:
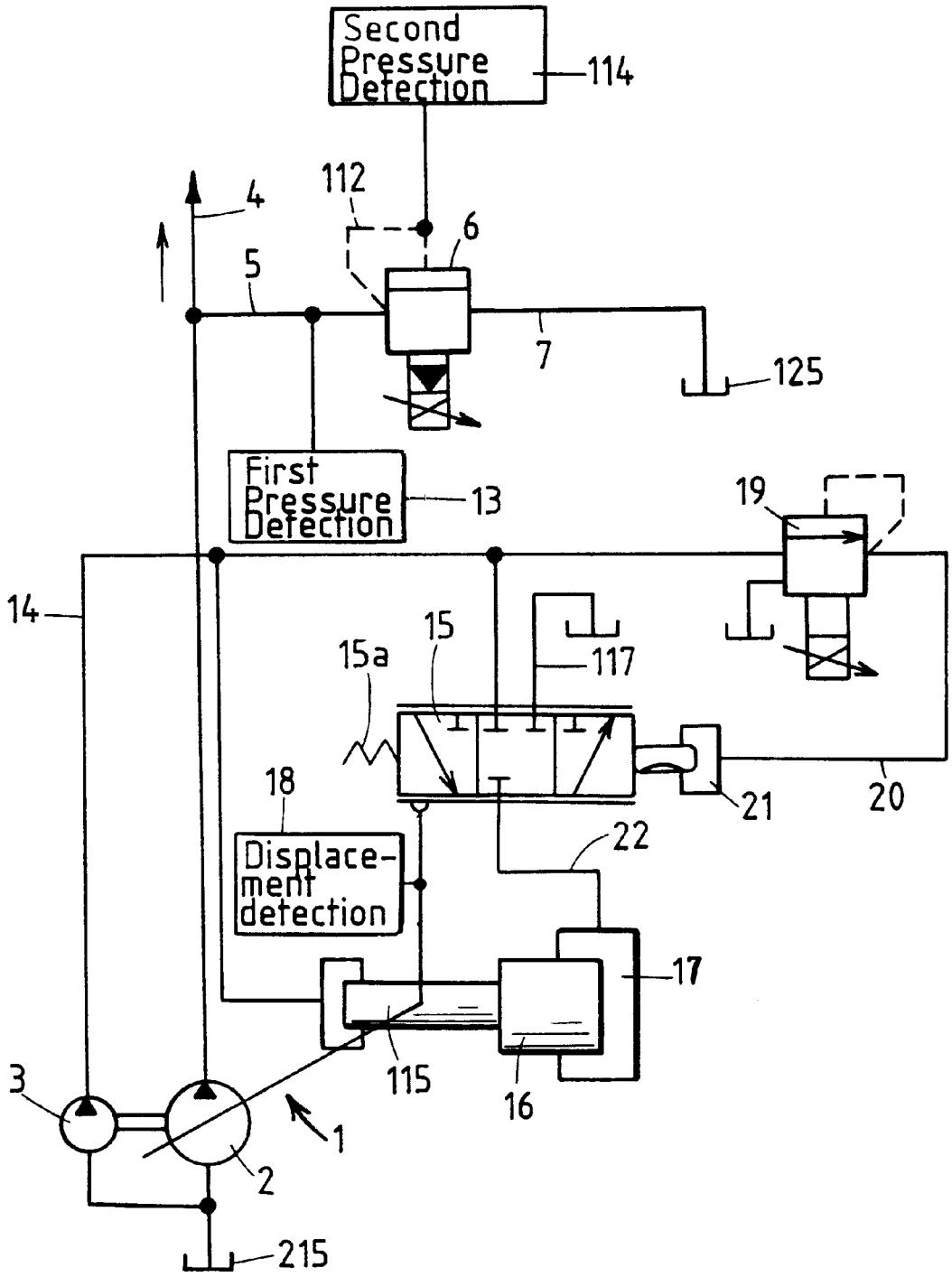
FIG. 2 is a diagram showing the specific structure of a hydraulic circuit represented by a control circuit in the control device of FIG. 1.

FIG. 1 is a block diagram showing the electrical structure of a control device for a variable displacement pump according to the first embodiment of the present invention. By the electrical structure, a pressure and a flow rate of the hydraulic operating fluid discharged from a variable displacement swash plate type axial piston pump 1 shown in FIG. 2 acting as the variable displacement pump, are controlled. In FIG. 2, for example, a molten synthetic resin in an injection molding machine is kept at a constant pressure in a metal mold by the hydraulic operating fluid fed from the pump 1. In such a constant pressure state, an injection flow rate, therefore, the flow rate of the hydraulic operating fluid can be caused to conform to the flow of the synthetic resin into the metal mold. A pump body 2 and an auxiliary pump 3 have rotary shafts coupled to each other, and are rotated at a constant speed by means of a driving source (not shown). The hydraulic operating fluid is fed from the pump body 2 to an actuator (not shown) such as a cylinder through a pipe line 4. An electromagnetic relief valve 6 is connected to the pipe line 4 through a pipe line 5. A part of the hydraulic operating fluid is returned to a tank 215 through a pipe line 7. With the structure of the pump 1 shown in FIG. 2, a hydraulic proportional control valve 15 and an electromagnetic proportional control valve 19 are used for controlling the flow rate. There is an advantage that the structure is comparatively simple.

Figure 3:
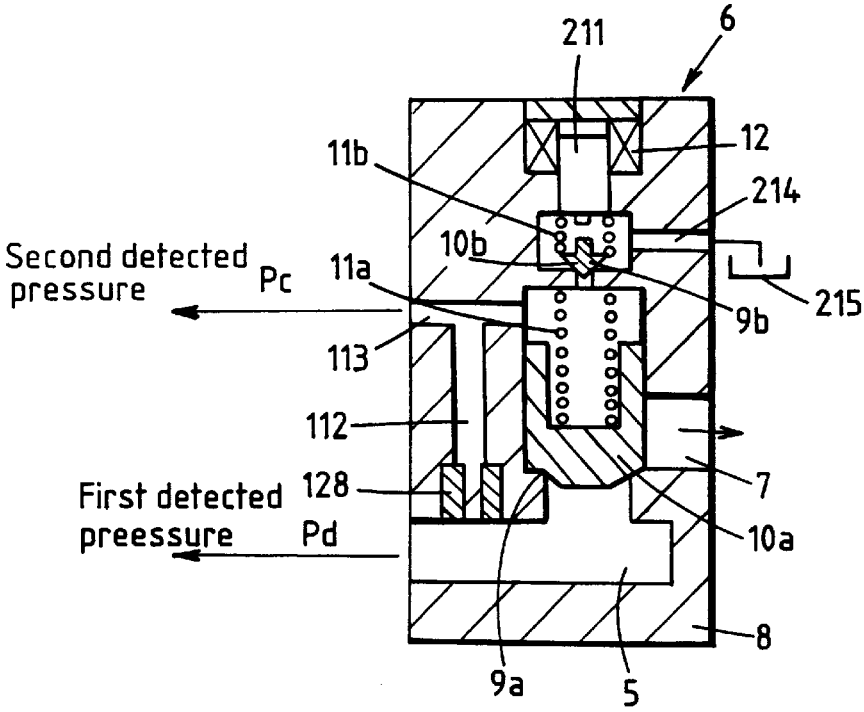
FIG. 3 is a sectional view showing an example of the specific structure of an electromagnetic relief valve in the hydraulic circuit of FIG. 2.

FIG. 3 is a simplified sectional view showing an example of the electromagnetic relief valve 6. A first valve seat 9*a* is formed in a valve housing 8, and elastic force is given in such a direction that a first valve body 10*a* is mounted by the elastic force of a first spring 11*a* . Furthermore, a second valve seat 9*b* is formed in the valve housing 8, and elastic force is given in such a direction that a second valve body 10*b* is mounted by the elastic force of a second spring 11*b*. The second valve body 10*b* is provided with a plunger 211. An electromagnetic coil 12 is excited so that the plunger 211 is moved in the direction to the second valve body 10*b*, thereby acting thereon. The pipe line 5 communicates with the back side of the first valve body 10*a* through a pilot passage 112. A pressure acts on the pilot passage 112 in such a direction that the first valve body 10*a* is mounted. The pilot passage 112 is provided with a throttle member 128 for regulating the passage of the hydraulic operating fluid flowing therein. Accordingly, if the pressure of the pipe line 5 acting on the first valve body 10*a* exceeds the pilot pressure of the pilot passage 112 and the elastic force of the first spring 11*a*, the first valve body 10*a* separates from the valve seat 9*a* so that a part of the hydraulic operating fluid flows from the pipe line 5 to the pipe line 7. The back side of the second valve body 10*b* communicates with the oil tank 215 through a passage 214. Accordingly, if a pressure applied to the back side of the first valve body 10*a* acting on the second valve body 10*b* exceeds the electromagnetic force of the electromagnetic coil 12 and the elastic force of the second spring 11*b*, the second valve body 10*b* separates from the valve seat 9*b* so that a part of the hydraulic operating fluid on the back side of the first valve body 10*a* flows into the oil tank 215 through the passage 214.

In the present embodiment, the pipe line 5 is provided with first pressure detecting means 13, and a passage 113 communicating with the pilot passage 112 is provided with second pressure detecting means 114. The first and second pressure detecting means 13 and 114 can be constituted by a pressure gauge for detecting the pressure of a fluid. The first pressure detecting means 13 detects the pressure of the hydraulic operating fluid in the pipe line 5, that is, the pressure of the hydraulic operating fluid fed from the pump body 2 through the pipe line 4, and the second pressure detecting means 114 detects the pressure of the pilot passage 112, that is, the pressure of the hydraulic operating fluid acting on the back side of the valve body 10*a* through the throttle member 128.

Referring to FIG. 2, the hydraulic operating fluid fed from the auxiliary pump 3 is supplied through a pipe line 14 to a minor cylinder chamber 116 for a minor piston 115, and is supplied through the hydraulic proportional control valve 15 to a major cylinder chamber 17 for a major piston 16 in order to change the inclination of a variable element which is a swash plate of the pump 1. The displacement position of the swash plate, that is, the displacement position of the piston 16 is detected by position detecting means 18 implemented by a potentiometer or the like. Consequently, the inclination of the swash plate, therefore, the flow rate of the hydraulic operating fluid discharged from the pipe line 4 is detected. Accordingly, the position detecting means 18 will be referred to as flow rate detecting means in the following description. The hydraulic operating fluid fed through the pipe line 14 is given from the electromagnetic proportional control valve 19 to a cylinder chamber 21 of the hydraulic proportional control valve 15 through a pipe line 20. Thus, the status of the hydraulic operating fluid fed from the hydraulic proportional control valve 15 to the cylinder chamber 17 through a pipe line 22 can continuously be changed.

In the present embodiment, when the elastic force of a spring 15*a* of the hydraulic proportional control valve 15 is balanced with the pressure of the hydraulic operating fluid acting on the cylinder chamber 21, the hydraulic proportional control valve 15 is held in a neutral position shown in FIG. 2, and the swash plate of the pump 1 is held in an angular position corresponding thereto. On the other hand, if the pressure of the hydraulic operating fluid is raised (or lowered) so that it becomes higher (or lower) than the elastic force of the spring 15*a*, the proportional control valve 15 is moved to the left (or the right) in FIG. 2 so that the pipe line 22 communicates with a pipe line 117 (or 14) through the proportional control valve 15 and the hydraulic operating fluid in the major cylinder chamber 17 is returned through the pipe lines 22 and 117 (or the hydraulic operating fluid fed through the pipe line 14 is supplied to the major cylinder chamber 17 through the pipe line 22). Accordingly, if the major piston 16 is moved to the right (or the left) in FIG. 2, the inclination of the swash plate is increased (or reduced) so that the discharge amount of the pump body 2 is reduced (or increased).

The electromagnetic relief valve 6 according to an example shown in FIG. 3 is equivalently replaced as a control circuit 32 having a transfer function Gp2 in FIG. 1. The pump 1 shown in FIG. 2 is equivalently replaced as a control circuit 32*a* having a transfer function Gq2 as denoted by the reference numeral 32*a* in FIG. 1. The control circuit 32*a* having the transfer function Gq2 equivalently includes the pump body 2, the auxiliary pump 3, the hydraulic proportional control valve 15, the swash plate, the piston 16 for driving the swash plate, the electromagnetic proportional control valve 19 and the like. A control amount led to a line 118 in FIG. 1 corresponds to a line for sending a signal indicative of a pressure Pc of the hydraulic operating fluid which is detected by the second pressure detecting means 114. A control amount led to a line 119 corresponds to a line for sending a signal indicative of a pressure Pd of the hydraulic operating fluid which is detected by the first pressure detecting means 13. Furthermore, the signal sent from the control circuit 32*a* through a line 118*a* corresponds to a line for sending a signal indicative of the detected flow rate of the hydraulic operating fluid fed through the pipe line 4 which is represented by the flow rate detecting means 18 for detecting the displacement position of the swash plate. A first negative feedback circuit 24 for controlling the pressure of the hydraulic operating fluid and a second negative feedback circuit 24*a* for controlling the flow rate of the hydraulic operating fluid have similar structures, and the same portions have the same reference numerals to which a subscript a is attached, correspondingly.

A target pressure for the pressure of the hydraulic operating fluid fed from the pump body 2 to the pipe line 4 is set by target pressure setting means 25. A signal indicative of the target pressure is sent from a line 26 to an open control circuit 31 having a transfer function Gp1 for performing feedforward control, and is sent to one of inputs of a first subtraction circuit 34. An output from the first pressure detecting means 13 is sent to the other input of the first subtraction circuit 34 through a line 27. The first subtraction circuit 34 leads, to a line 28, a signal indicative of a first deviation which is obtained by subtracting the signal indicative of the pressure Pd detected by the first pressure detecting means 13 from the signal indicative of the target pressure set by the target pressure setting means 25, and sends the same signal to a first compensation circuit 29. An output of the open control circuit 31 and a pressure correction signal led from the first compensation circuit 29 to a line 77 are added in a first arithmetic circuit 75. A signal led from the first arithmetic circuit 75 to a line 78 is transmitted to an arithmetic circuit 120, is subjected to an arithmetic processing in the arithmetic circuit 120, and is given from the line 121 to the electromagnetic coil 12 of the electromagnetic relief valve 6. The control device is further provided with a phase lead compensation circuit 79. The first compensation circuit 29 obtains a pressure correction signal for making the first deviation zero and leads the pressure correction signal to the line 77 in response to the output of the first subtraction circuit 34.

In the present embodiment, the signal indicative of the pressure Pd detected by the first pressure detecting means 13 is led to the line 119 and is then transmitted to a differential pressure calculation circuit 122 through a line 123, and the signal indicative of the pressure Pc detected by the second pressure detecting means 114 is led to a line 124 and is then transmitted to the differential pressure calculation circuit 122. The differential pressure calculation circuit 122 subtracts the signal indicative of the pressure Pc detected by the second pressure detecting means 114 from the signal indicative of the pressure Pd detected by the first pressure detecting means 13 to generate a difference (Pd−Pc) between the detected pressures. A signal indicative of the difference (Pd−Pc) sent from the differential pressure calculation circuit 122 is led to a line 125, and is given to a control circuit 126 having a transfer function HP5 and is then transmitted to the arithmetic circuit 120 through a line 127. The arithmetic circuit 120 subtracts a signal sent from the line 127 from a signal sent from the first arithmetic circuit 75, and gives the obtained signal to the electromagnetic coil 12.

The flow rate of the hydraulic operating fluid discharged from the pipe line 4 of the pump 1 is set by target flow rate setting means 25*a*. An output is given to one of separate contacts 82 in change-over switch means 81 of input change-over means 80 through a line 26*a*. The change-over switch means 81 has another separate contact 83. A common contact 84 can be changed over into the separate contact 82 or 83 to be conducted. An output of the common contact 84 is given from a line 85 to an open control circuit 31*a* having a transfer function Gq1. An output of the open control circuit 31*a* is given to a second arithmetic circuit 75*a*, and is added to a flow rate correction signal led from a second compensation circuit 29*a* to a line 77*a* so that an arithmetic processing is performed. The output of the second arithmetic circuit 75*a* is given to the electromagnetic proportional control valve 19 of the pump 1 through a line 78*a*. Consequently, the piston 16 is driven. Accordingly, the swash plate is angular displacement driven so that the discharge flow rate is changed.

A signal indicative of the flow rate of the hydraulic operating fluid discharged from the pump body 2 to the line 4 which is detected by the flow rate detecting means 18 is sent from a line 27*a* to one of the inputs of a second subtraction circuit 34*a*, and a signal input from a line 85 is sent to the other input of the second subtraction circuit 34*a*. The second subtraction circuit 34*a* subtracts a signal indicative of the detected flow rate of the line 27*a*from the signal input from the line 85, and leads a signal indicative of a second deviation to a line 28*a* and gives the same signal to a second compensation circuit 29*a*. The second compensation circuit 29*a* leads, to a line 77*a*, a flow rate correction signal for displacing the swash plate, therefore, the piston 16 in response to the output of the second subtraction circuit 34*a* in such a manner that the second deviation reaches zero as described above. The output of the flow rate detecting means 18 is given to a phase lead compensation circuit 79*a*. The output of the phase lead compensation circuit 79*a* is given to an arithmetic circuit 75*a* to perform subtraction. By the signal led from the arithmetic circuit 75*a* to the line 78*a*, the electromagnetic proportional control valve 19 is controlled as described above.

Figure 4:
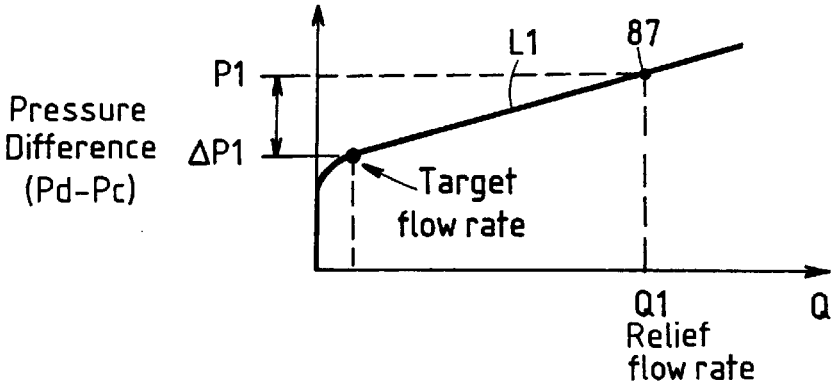
FIG. 4 is a chart illustrating a relationship between a relief flow rate of the electromagnetic relief valve and a difference between pressures detected by first and second pressure detecting means.

FIG. 4 is a graph showing the pressure override characteristics of the electromagnetic relief valve 6. In the pressure control operation state of the hydraulic operating fluid in the pipe line 4 for reaching the target pressure of the target pressure setting means 25, the electromagnetic relief valve 6 sets a relief flow rate Q to zero at a cracking pressure, and is opened at a pressure which is slightly higher than the cracking pressure so that a part of the hydraulic operating fluid is caused to flow out from the line 7 with a small relief flow rate. If the target pressure is set to a pressure which is a little higher than the cracking pressure, a part of the hydraulic operating fluid is subjected to relief through the line 7 with a small relief flow rate at the target pressure. As shown by a line L1 in FIG. 4, there is a characteristic that the relief flow rate and the difference (Pd−Pc) between the pressures detected by the first and second pressure detecting means 13 and 114 are increased with a substantially proportional relationship within a range in which the flow rate exceeds the target flow rate. If the relief flow rate is increased, a pressure tends to be higher than the target pressure by the pressure override characteristics. Accordingly, the pressure correction signal led from the first compensation circuit 29 to the line 77 is a deviation signal for lowering the pressure detected by the first pressure detecting means 13. The level of the pressure correction signal has a relationship of a linear function, for example, a proportional relationship with an unnecessary relief flow rate surplus to the small relief flow rate.

In the present embodiment, a signal indicative of the difference (Pd −Pc) between the pressures detected by the first pressure detecting means 13 and the second pressure detecting means 114 which has almost the same relationship with a rise in the pressure in the override characteristics is subtracted from the signal indicative of the flow rate of the hydraulic operating fluid which is detected by the flow rate detecting means 18, and a value obtained by the subtraction is given as an input signal acting as the target flow rate of the second negative feedback circuit 24*a* during the pressure control operation. More specifically, in case of a relief flow rate Q1 in FIG. 4, when the difference (Pd−Pc) between the pressures detected by the first and second pressure detecting means 13 and 114 is increased to reach a pressure difference P1 indicated as the reference numeral 87, a pressure correction signal led from the first compensation circuit 29 to the line 77 is a deviation signal for decreasing the pressure by a pressure difference ΔP1 and is given, to the line 85, as an input signal to reach the target flow rate of the second compensation circuit 29*a* in such a manner that the relief flow rate Q1 reaches a small relief flow rate close to zero (the relief flow rate in the target pressure), which will be described below. Thus, a great relief flow rate Q1 to be wasted can be prevented from being generated. Consequently, it is possible to reduce a dead flow rate as much as possible.

In the control device according to the present embodiment, change-over control means 88 is provided. A second arithmetic circuit 89 provided in the change-over control means 88 includes a comparison circuit 91 for leading, to a line 90, only a positive differential pressure signal sent from the differential pressure calculation circuit 122, and a control circuit 92 having a transfer function Hp4 in response to the signal indicative of the differential pressure (Pd−Pc) which is sent through the line 90. The differential pressure of the differential pressure calculation circuit 122 is positive when the pressure Pd detected by the first pressure detecting means 13 exceeds the pressure Pc detected by the second pressure detecting means 114. At that time, the signal indicative of the pressure difference (Pd−Pc) is given to an arithmetic circuit 93 as described above. The arithmetic circuit 93 serves to subtract an output sent from the control circuit 92 provided in the first arithmetic circuit 89 from the signal indicative of the flow rate detected by the flow rate detecting means 18 which is sent through the line 27*a*, leads, to a line 94, a signal indicative of a flow rate obtained by the subtraction of the difference from the detected flow rate, and gives the same signal to the separate contact 83 of the change-over switch means 81. Since the signal indicative of the pressure difference which is sent from the differential pressure calculation circuit 122 has no hysteresis characteristics and includes no signal for correction, it has less errors. Therefore, the control of the flow rate of the hydraulic operating fluid to be described below can be performed with high precision by utilizing the pressure difference signal.

Change-over switch control means 95 constituting input change-over means 80 together with the change-over switch means 81 conducts the common contact 84 of the change-over switch means 81 to the separate contact 83 when the pressure correction signal of the first compensation circuit 29 is negative, that is, the pressure detected by the first pressure detecting means 13 exceeds the target pressure set by the target pressure setting means 25, thereby giving the output of the arithmetic circuit 93, through the line 85, as an input signal which indicates the target pressure of the second compensation circuit 29*a*. Furthermore, the change-over switch control means 95 conducts the common contact 84 of the change-over switch means 81 to the separate contact 82 in response to the pressure correction signal of the first compensation circuit 29 when the pressure detected by the first pressure detecting means 13 is equal to or lower than the target pressure, thereby giving, from the line 26*a* to the line 85, the signal indicative of the target flow rate sent from the target flow rate setting means 25*a* and causing the same signal to be an input signal of the second compensation circuit 29*a* so that the pressure of the hydraulic operating fluid can be raised to reach the target pressure.

Figure 5:
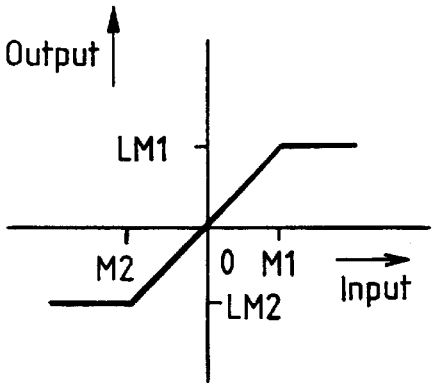
FIG. 5 is a chart showing an input-output characteristic of a limiter provided in the control device of FIG. 1.
Figure 6A:
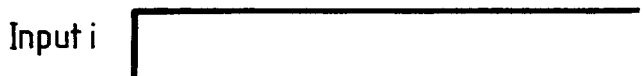
FIGS. 6(A) to 6(E) are charts illustrating the operation of the control device shown in FIG. 1.
Figure 6B:
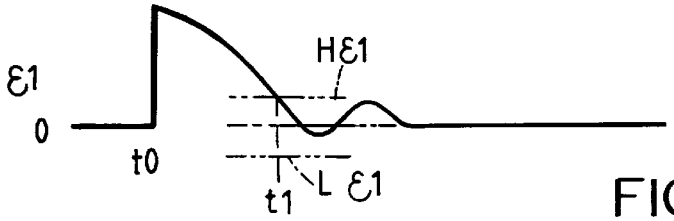
Figure 6C:
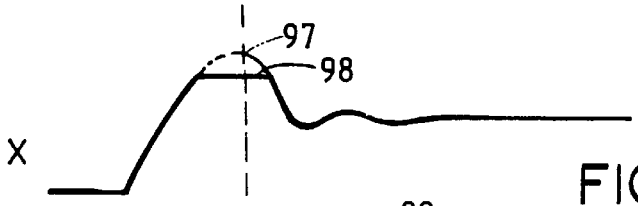
Figure 6D:
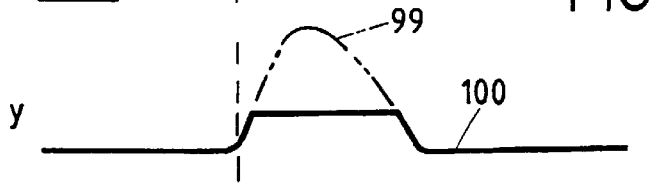
Figure 6E:
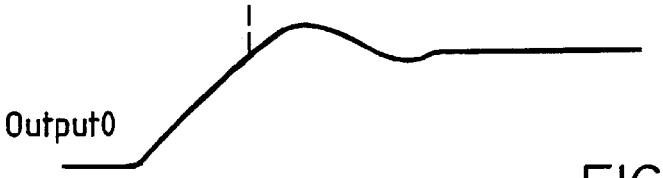

The specific structure of the first compensation circuit 29 will be described again with reference to FIG. 1. A signal indicative of the first deviation signal which is sent from the first subtraction circuit 34 to the line 28 is given to a compensation circuit 51 having a transfer function Hp1, and the output of the compensation circuit 51 is given to a limiter 50. As shown in FIG. 5, the limiter 50 limits an output to M1 and M2 when the signal input from the compensation circuit 51 gets out of a range of M1 to M2. The output of the first limiter 50 is added in the arithmetic circuit 65. The output of the first subtraction circuit 34 which is sent through the line 28 is also given to a compensation circuit 62 having a transfer function Hp2 through switch means 76. The output of the compensation circuit 62 is given to an integral compensation circuit 61 so that an integral operation for the output of the first subtraction circuit 34 is performed. The output of the integral compensation circuit 61 is given to a second limiter 60 so that the same limiter operation as in FIG. 5 described above is performed. The arithmetic circuit 65 adds the output of the limiter 60 to the output of the limiter 50 described above, and leads the added outputs as a pressure correction signal to the line 77.

Level discriminating means 96 provided in the first compensation circuit 29 cuts off the switch means 76 when an absolute value of the first deviation led from the first subtraction circuit 34 to the line 28 exceeds a predetermined value. Consequently, the action of the compensation circuit 62, the integral compensation circuit 61 and the second limiter 60 is halted. When the level discriminating means 96 discriminates that the absolute value of the first deviation is equal to or smaller than the predetermined value, it causes the switch means 76 to be conducted, thereby permitting the integral operation to be performed by the integral compensation circuit 61.

FIG. 6 is a waveform diagram illustrating the operation of the first compensation circuit 29. A signal sent from the target pressure setting means 25 to the line 26 has a stepped waveform shown in FIG. 6 (1). At this time, the waveform of the first deviation led from the first subtraction circuit 34 to the line 28 is shown in FIG. 6 (2). Absolute values of discrimination levels Hϵ1 and Lϵ1 shown in FIG. 6 (2) may be equal to each other. The compensation circuit 51 outputs a signal having a waveform shown by the reference numeral 97 of FIG. 6 (3). As shown in a solid line of FIG. 6 (3), the first limiter 50 limits the output of the compensation circuit 51 as shown by the reference numeral 98, and gives the same output to the addition circuit 65.

The level discriminating means 96 serves to discriminate the first deviation led from the first subtraction circuit 34 to the line 28 with the upper and lower discrimination levels Hϵ1 and Lϵ1, and to cut off the switch means 76 when the first deviation is out of a range of Hϵ1 to Lϵ1. After a time t1, the first deviation is kept within the above-mentioned upper and lower discrimination levels Hϵ1 and Lϵ1. Therefore, the switch means 76 is conducted. Accordingly, an integral signal having a waveform shown by the reference numeral 99 in FIG. 6 (4) is obtained from the integral compensation circuit 61. The second limiter 60 limits the output of the integral compensation circuit 61 as shown by the reference numeral 100, and gives, to the addition circuit 65, a signal having a waveform shown in a solid line of FIG. 6 (4). Thus, a signal for pressure control to be performed by the electromagnetic relief valve 6 shown in FIG. 6 (5) is sent to the line 78 by the action of the first compensation circuit 29, the open control circuit 31 and the phase lead compensation circuit 79.

The second compensation circuit 29*a* related to the flow rate of the hydraulic operating fluid of the pump 1 has the same structure as in the above-mentioned first compensation circuit 29, and the same reference numerals having a subscript a attached thereto denote the same portions, correspondingly. In the second compensation circuit 29*a*, a flow rate may be used instead of the pressure related to the description of the above-mentioned first compensation circuit 29, and the electromagnetic proportional control valve 19 for displacing the piston 16, therefore, the swash plate may be operated instead of controlling the electromagnetic relief valve 6.

In the phase lead compensation circuit 79, the output of the first pressure detecting means 13 which is obtained from the line 23 is given to a compensation circuit 73 having a transfer function Hp3, the output of the compensation circuit 73 is given to a phase lead circuit 74, and the output of the phase lead circuit 74 is subtracted in the arithmetic circuit 75. Consequently, a signal sent from the line 78 controls the overshoot of the pressure of the hydraulic operating fluid by the electromagnetic relief valve 6 so that subsequent damping can be promoted. This is the same as in another phase lead compensation circuit 79*a* for the flow rate of the hydraulic operating fluid, and the overshoot of a flow rate by the displacement of the piston 16 and the swash plate can be prevented from being generated so that subsequent damping can be promoted.

In the present embodiment, a signal calculated in the arithmetic circuit 75 is further transmitted to the arithmetic circuit 120. In the arithmetic circuit 120, a signal (which has passed through the control circuit 126 having a transfer function HP5) indicative of the difference pressure (Pd−Pc) sent from the differential pressure calculation circuit 122 is subtracted from the signal sent from the arithmetic circuit 75. Thus, a surge pressure generated during the operation of an actuator such as a cylinder can also be detected by utilizing the signal indicative of the differential pressure of the differential pressure calculation circuit 122, and the control for reducing the surge pressure can be performed by utilizing the signal indicative of the differential pressure to control the pressure of the hydraulic operating fluid. Thus, the surge pressure which easily makes troubles in the pressure control with high precision can remarkably be reduced.

The first embodiment has been described above.

Next, a second embodiment of the present invention will be described with reference to FIGS. 7 and 8. In the control device for the variable displacement pump according to the first embodiment described above, the target pressure of the hydraulic operating fluid in the variable displacement pump is set by the target pressure setting means. Therefore, the relief pressure of the electromagnetic relief valve goes to the set target pressure. In general, the response speed of the electromagnetic relief valve is comparatively lower than the change speed of the pressure. In some cases where the pressure of the hydraulic operating fluid fed from the variable displacement pump, that is, the load pressure is rapidly raised, the working speed of the electromagnetic relief valve is not enough so that the load pressure becomes higher than the target pressure and a high surge pressure is generated.

For example, in a case where a hydraulic cylinder mechanism is actuated by the hydraulic operating fluid fed from the variable displacement pump, the pressure of the hydraulic operating fluid is rapidly raised beyond the target pressure when the piston comes in contact with a cylinder end. At this time, the pressure of the hydraulic operating fluid is rapidly raised. Therefore, the operation of the electromagnetic relief valve cannot fully respond to the rise in the pressure of the hydraulic operating fluid so that there is a possibility that a high surge pressure might be generated. If the high surge pressure is thus generated, an impact is increased so that a high impulsive sound is made to cause noises.

In a control device for a variable displacement pump according to a second embodiment, a pressure of a hydraulic operating fluid can be kept at a target pressure and a high surge pressure can be prevented from being generated.

Figure 7:
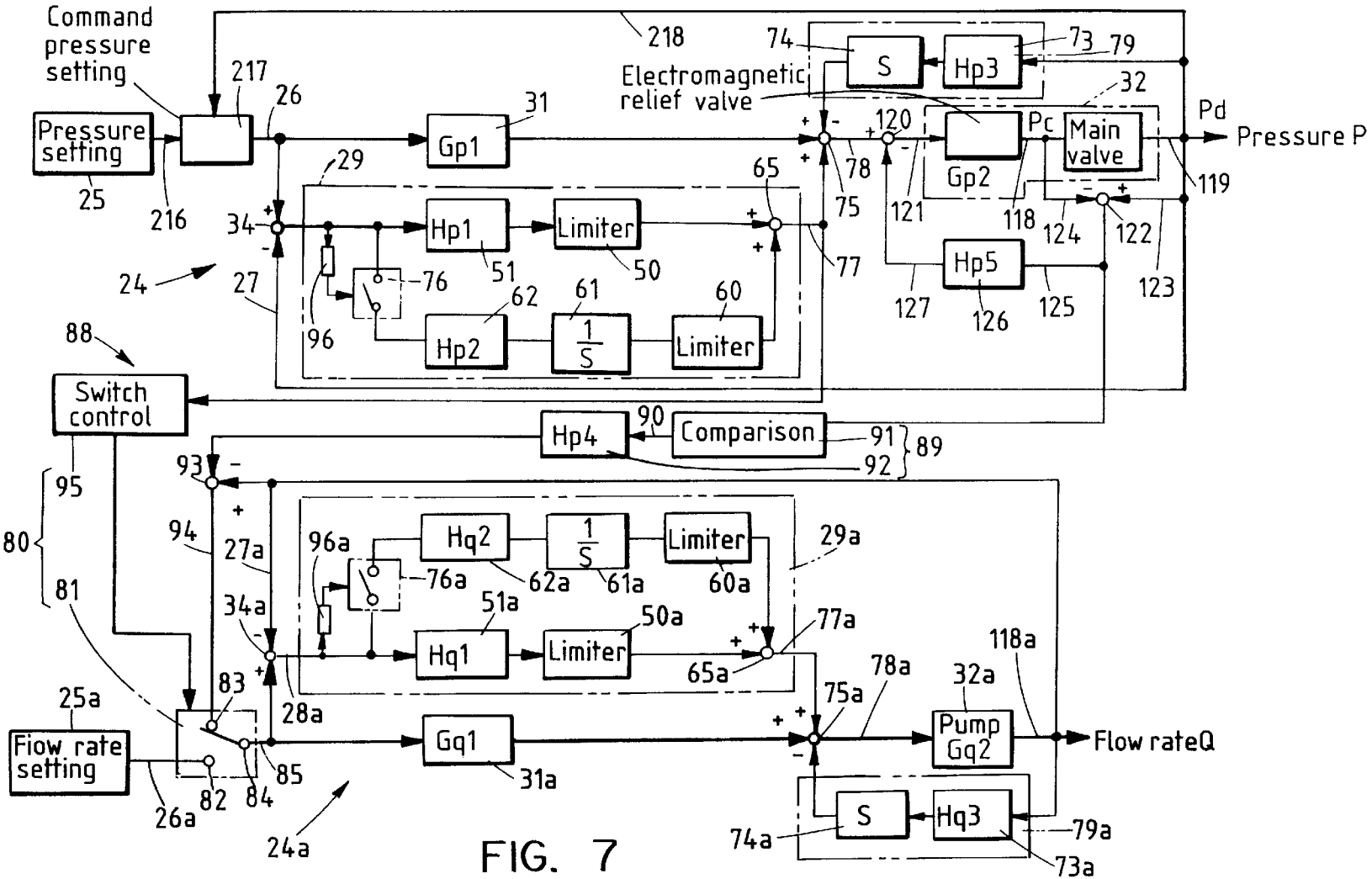
FIG. 7 is a block diagram showing the whole structure of a control device for a variable displacement pump according to a second embodiment of the present invention.

FIG. 7 is a block diagram showing the electrical structure of the control device for the variable displacement pump according to the second embodiment of the present invention. The structure according to the second embodiment is different from that according to the first embodiment shown in FIG. 1 in the following respects.

More specifically, the second embodiment is different from the first embodiment in that command pressure setting means 217 is provided. A signal indicative of a target pressure which is sent from target pressure setting means 25 and a signal indicative of a detected pressure which is sent from first pressure detecting means 13 are transmitted to the command pressure setting means 217. A signal indicative of a target command pressure is sent from the command pressure setting means 217 to an open control circuit 31 and a first subtraction circuit 34. Other structures in the second embodiment are the same as those in the first embodiment.

The functions of components according to the second embodiment which are particularly different from those of the first embodiment will be described below in detail.

As is apparent from FIG. 7, the target pressure for the pressure of the hydraulic operating fluid fed from a pump body 2 to a pipe line 4 is set by the target pressure setting means 25 in the present embodiment. A signal indicative of the target pressure is transmitted to the command pressure setting means 217 through a line 216. The command pressure setting means 217 sets a target command pressure in relation to the target pressure set by the target pressure setting means 25. A signal indicative of the target command pressure is transmitted as a pressure signal for setting the pressure of the hydraulic operating fluid to the open control circuit 31 through a line 26, and is transmitted to one of the inputs of the first subtraction circuit 34. The signal indicative of the pressure detected by the first pressure detecting means 13 is transmitted to the command pressure setting means 217 through a line 218. The command pressure setting means 217 sets a target command pressure based on the signal indicative of the detected pressure which is sent from the first pressure detecting means 13.

Figure 8:
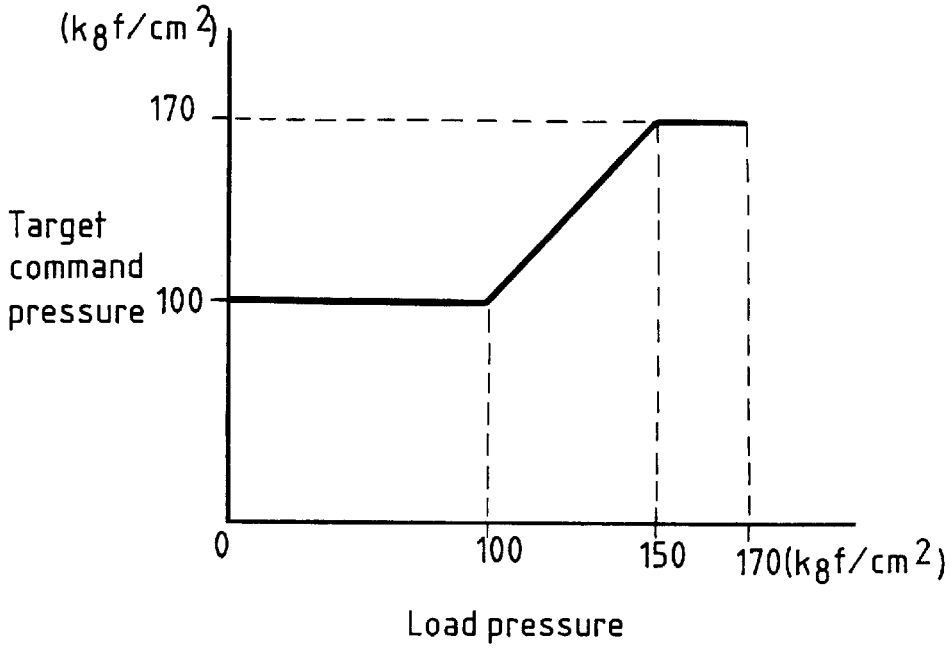
FIG. 8 is a chart showing a relationship between a pressure (a target load pressure) detected by first pressure detecting means and a target command pressure.

With reference to FIG. 8, the setting of the target command pressure by the command pressure setting means 217 will be described. The command pressure setting means 217 is constituted by a memory having a predetermined target command pressure pattern stored therein, for example. A pattern shown in FIG. 8 is stored as a map in the command pressure setting means 217, for example. A target command pressure pattern shown in FIG. 8 is obtained when a target pressure set by the target pressure setting means 25 is 170 kgf/cm$^2$, for example, and indicates a relationship between a load pressure, that is, the pressure detected by the first pressure detecting means 13 and the target command pressure set by the command pressure setting means 217.

In the target command pressure pattern shown in FIG. 8, when the pressure detected by the first pressure detecting means 13 is equal to or lower than a first predetermined pressure which is lower than the target pressure, for example, 100 kgf/cm$^2$, the command pressure setting means 217 sets a first command pressure, for example, 100 kg /cm$^2$ as the target command pressure. At this time, accordingly, the hydraulic operating fluid fed from the pump body 2 is controlled in such a manner that the pressure thereof reaches the first command pressure. When the pressure detected by the first pressure detecting means 13 is raised to a second predetermined pressure which is higher than the first predetermined pressure, for example, 150 kgf/cm$^2$, the command pressure setting means 217 sets, as a target command pressure, the target pressure set by the target pressure setting means 25. If the pressure detected by the first pressure detecting means 13 exceeds the second predetermined pressure, the target pressure is set as a target command pressure. Thus, if the pressure detected by the first pressure detecting means 13 reaches the second predetermined pressure which is lower than the target pressure, the target pressure is set as the target command pressure. Therefore, when the detected pressure reaches the target pressure, the control for changing the target pressure into the target command pressure has already been performed. Accordingly, the pressure of the hydraulic operating fluid can be kept at the target pressure as will be described below.

When the pressure detected by the first pressure detecting means 13 is higher than the first predetermined pressure, for example, 100 kgf/cm$^2$ and is lower than the second predetermined pressure, for example, 150 kgf/cm$^2$, the command pressure setting means 217 sets the target command pressure in such a manner that the target command pressure is gradually increased proportionally as the pressure detected by the first pressure detecting means 13 is raised. In the present embodiment, if the pressure detected by the first pressure detecting means 13 is raised from 100 kgf/cm$^2$ to 150 kgf/cm$^2$, the target command pressure set by the command pressure setting means 217 is proportionally increased from 100 kgf/cm$^2$ to 170 kgf/cm$^2$. By gradually increasing the target command pressure proportionally, thus, the pressure of the hydraulic operating fluid can be changed from the first command pressure to the target pressure while controlling a variation in the pressure of the hydraulic operating fluid.

By employing such a target command pressure pattern, the following functions and effects can be achieved. More specifically, in a normal control state, the pressure detected by the first pressure detecting means 13 is lower than the first predetermined pressure, and the command pressure setting means 217 sets the first command pressure, for example, 100 kgf/cm$^2$ as the target command pressure. Accordingly, in such a control state, if the load pressure is rapidly raised, for example, the piston of the hydraulic cylinder mechanism directly comes in contact with the cylinder end, the pressure of the hydraulic operating fluid is rapidly raised so that a surge pressure is generated. However, since the target command pressure set by the command pressure setting means 217 is set to the first command pressure, if the surge pressure is generated, the surge pressure is not higher than the target pressure set by the target pressure setting means 25 (or the same surge pressure does not greatly exceed the target pressure even if it is higher). Consequently, a rise in the pressure of the hydraulic operating fluid can be prevented from exceeding the target pressure. As is apparent from the above description, if the pressure detected by the first pressure detecting means 13 is raised, the target command pressure is also raised. If the pressure detected by the first pressure detecting means 13 is equal to or higher than the second predetermined pressure, the command pressure setting means 217 sets the target pressure, for example, of 170 kgf/cm$^2$ as the target command pressure. Therefore, the hydraulic operating fluid is held to reach the target pressure, and can be kept at a predetermined target pressure while controlling a rise in the pressure of the hydraulic operating fluid which exceeds the target pressure.

Such a target command pressure pattern can properly be selected depending on the capacity of the variable displacement pump, the capability thereof, the target pressure set by the target pressure setting means 25, and the like. In the target command pressure pattern shown in FIG. 8, for example, if the pressure detected by the first pressure detecting means 13 is raised to the second predetermined pressure or more, the command pressure setting means 217 sets the target pressure as the target command pressure. Instead, it is also possible to have a structure in which the command pressure setting means 217 sets the target pressure as the target command pressure if the detected pressure is raised to reach the target pressure. In this case, it is desirable that the target command pressure set by the command pressure setting means 217 should also be gradually increased proportionally as the pressure detected by the first pressure detecting means 13 is raised from the first predetermined pressure to the target pressure in order to prevent the pressure of the hydraulic operating fluid from being varied at the time of a change from the first command pressure to the target pressure.

The second embodiment has been described above.

Figure 10:
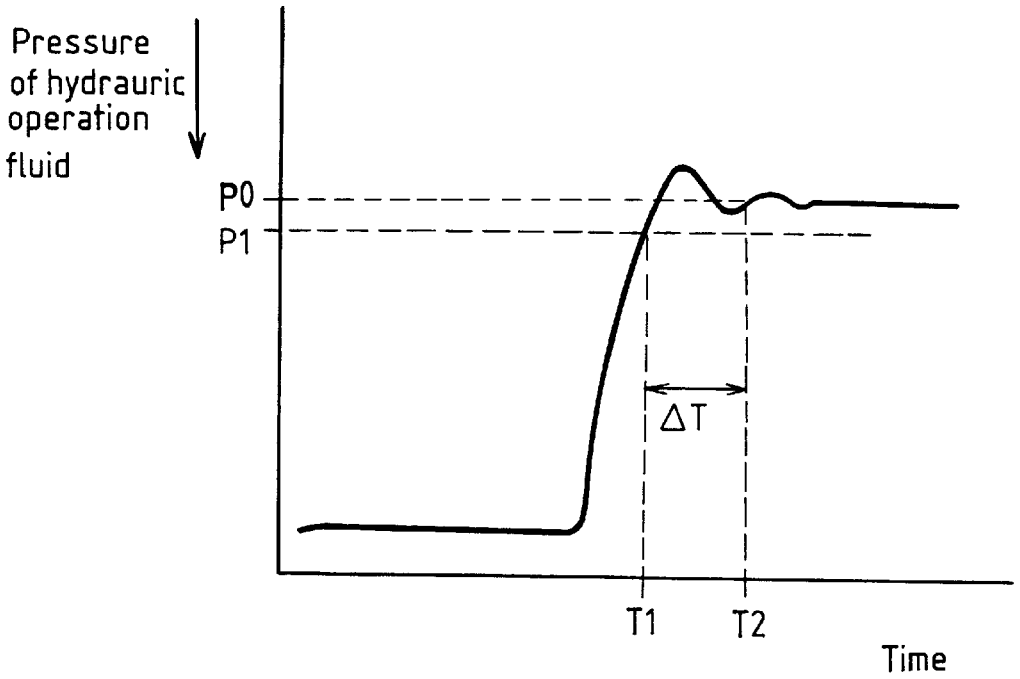
FIG. 10 is a chart illustrating the delay operation of a first integral compensation circuit provided in the control device.

Next, a third embodiment of the present invention will be described with reference to FIGS. 9 to 11. In the control device for the variable displacement pump according to the first embodiment described above, for example, if the pressure of the hydraulic operating fluid fed from the variable displacement pump approximates to the target pressure set by the target pressure setting means, the first level discriminating means discriminates the pressure state to bring the first switch means into a closing state. Consequently, the signal output from the first subtraction circuit is transmitted to the first integral compensation circuit. The first integral compensation circuit performs an integral processing for the output signal. In general, the integral processing to be performed by the integral compensation circuit includes a delay element. Therefore, overshoot is caused in dynamic control (undershoot is also caused as the case may be) due to the delay element. Accordingly, if the integral processing is performed in such a pressure control for the hydraulic operating fluid, there is a possibility that an integral value obtained from the first integral compensation circuit might be increased by the overshoot (and the undershoot) during holding at the target pressure so that a delay of static stability in the pressure of the hydraulic operating fluid might be caused.

In the control device for the variable displacement pump according to the first embodiment, the flow rate of the hydraulic operating fluid fed from the variable displacement pump is also controlled by means of the second integral compensation circuit, the second switch means and the second level discriminating means in the same manner as the pressure thereof. Accordingly, there is a possibility that such a delay of the static stability might be caused also in the flow rate control of the hydraulic operating fluid.

In a control device for a variable displacement pump according to a third embodiment, a pressure of a hydraulic operating fluid fed from the variable displacement pump can be statically stabilized in a short time. Furthermore, a flow rate of the hydraulic operating fluid fed from the variable displacement pump can be statically stabilized in a short time.

Figure 9:
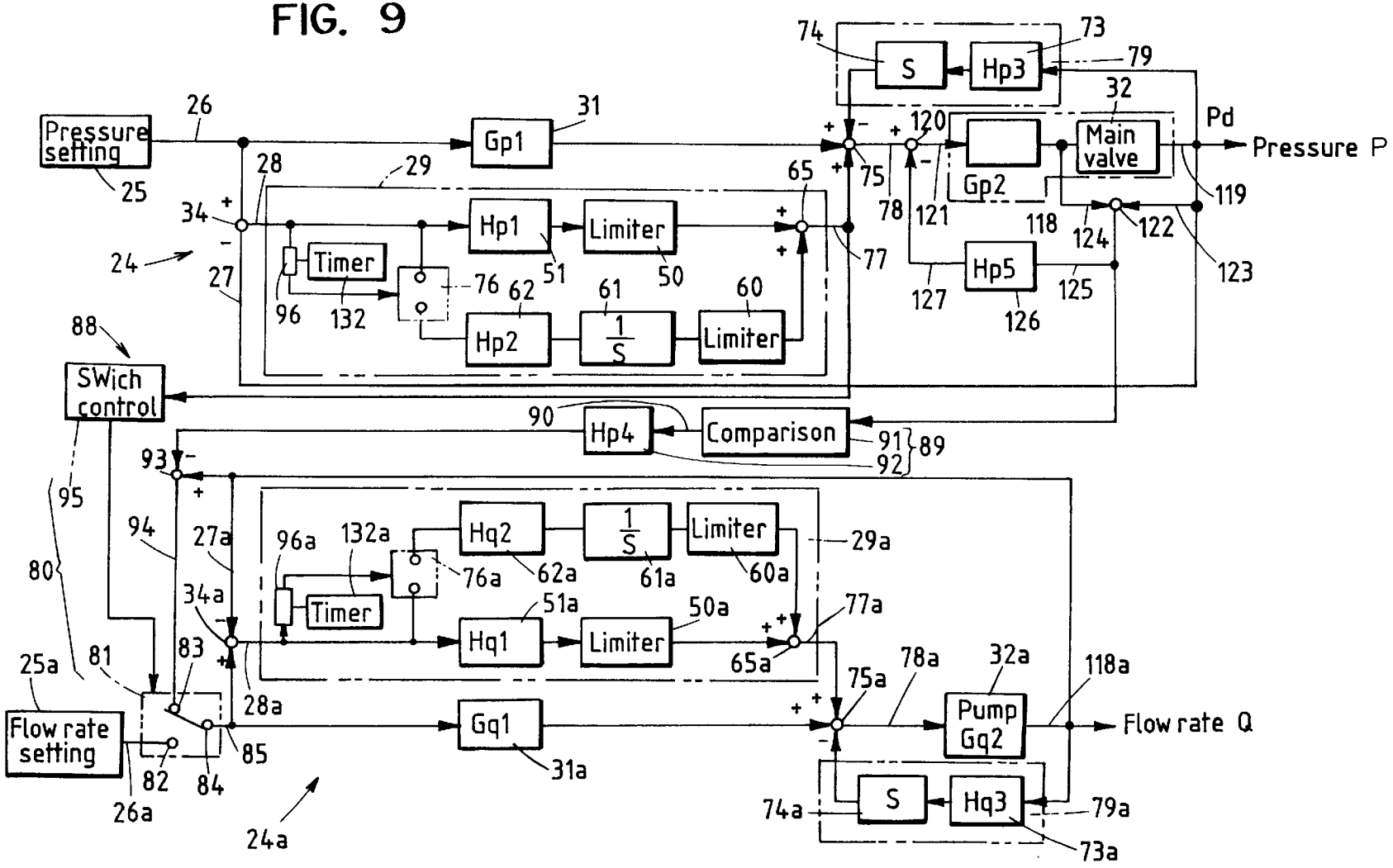
FIG. 9 is a block diagram showing the whole structure of a control device for a variable displacement pump according to a third embodiment of the present invention.

FIG. 9 is a block diagram showing the electrical structure of the control device for the variable displacement pump according to the third embodiment of the present invention. The structure according to the third embodiment is different from that according to the first embodiment shown in FIG. 1 in the following respects.

More specifically, the third embodiment is different from the first embodiment in that first timer means 132 is provided in a first compensation circuit 29 and second timer means 132*a* is provided in a second compensation circuit 29*a*. The first timer means 132 is connected to first level discriminating means 96, and the second timer means 132*a* is connected to second level discriminating means 96*a*. Other structures according to the third embodiment are the same as those in the first embodiment.

The functions of components in the third embodiment which are particularly different from those in the first embodiment will be described below in detail.

As shown in FIG. 9, the first compensation circuit 29 is provided with the first level discriminating means 96 and the first timer means 132 in order to open and close first switch means 76. The first level discriminating means 96 provided in the first compensation circuit 29 performs the following operation. When an absolute value of a first deviation led from a first subtraction circuit 34 to a line 28 exceeds a predetermined value, that is, the absolute value of the first deviation exceeds 10 kgf/cm$^2$ if a target pressure is set to 170 kgf/cm$^2$, for example, the first deviation gets out of a first range. Consequently, the first level discriminating means 96 brings the first switch means 76 into an opening state. Accordingly, a signal output from the first subtraction circuit 34 is not transmitted to a first integral compensation circuit 61. On the other hand, if a pressure of a hydraulic operating fluid fed from a pump body 2 is raised so that the first deviation of the first subtraction circuit 34 gets into the first range (that is, 160 kgf/cm$^2$<Pd<180 kgf/cm$^2$, for example), the first level discriminating means 96 generates an operating signal.

When the operating signal is thus generated, the first timer means 132 starts timing. After the first timer means 132 times a first time, for example, a time set to about 0.2 to 0.5 second, the first switch means 76 is held in a closing state by the operating signal. When the first switch means 76 is brought into the closing state, the signal output from the first subtraction circuit 34 is transmitted to a compensation circuit 62 and the first integral compensation circuit 61 through the first switch means 76 so that an integral processing is started by the first integral compensation circuit 61. Since the first integral compensation circuit 61 is thus provided, a predetermined deviation doesn't remain in the first deviation of the first subtraction circuit 34 when the pressure of the hydraulic operating fluid is to be controlled.

Thus, if the operation of the first integral compensation circuit 61 is somewhat delayed, the following effects can be obtained. Description will be given with reference to FIG. 10. In a case where the first timer means 132 is not provided, the first switch means 76 is brought into the closing state if the pressure of the hydraulic operating fluid is raised so that the first deviation of the first subtraction circuit 34 gets into the first range at a time T1, that is, the pressure of the hydraulic operating fluid reaches a pressure P1, for example, 160 kgf/cm$^2$. Consequently, the integral processing for the output signal sent from the first subtraction circuit 34 is started by the first integral compensation circuit 61 from this point of time. At this time, when the overshoot shown in FIG. 10 is generated in the pressure control of the hydraulic operating fluid, the integral value of the first integral compensation circuit 61 is increased due to the overshoot so that the first compensation circuit 29 gives an instruction to greatly lower the pressure of the hydraulic operating fluid. Consequently, the undershoot is generated. If the undershoot is generated, the integral value of the first integral compensation circuit 61 is increased due to the undershoot. In this case, the first compensation circuit 29 gives an instruction to greatly raise the pressure of the first hydraulic operating fluid. Consequently, the overshoot is generated. Thus, if the overshoot and/or the undershoot are/is generated, the convergence of the pressure of the hydraulic operating fluid on the target pressure is delayed so that static stability thereof is delayed. On the other hand, if the first timer means 132 is provided so that the start of the integral processing of the first integral compensation circuit 61 is delayed by a first time ΔT, the integral processing by the first integral compensation circuit 61 is not performed at the time of the overshoot and the subsequent undershoot if necessary. When the pressure of the hydraulic operating fluid is somewhat stabilized after great overshoot and subsequent undershoot if necessary, the integral processing is started. Accordingly, an increase in the integral value of the first integral compensation circuit 61 can be avoided so that the pressure of the hydraulic operating fluid can be stabilized in a short time. As is apparent from the above description, the first time ΔT is set by the first timer means 132 in consideration of the generation period of the overshoot and/or the undershoot which influence(s) the integral processing of the first integral compensation circuit 61. The first timer means 132 is thus provided so that the time for starting the integral processing can be delayed with a comparatively simple structure. Consequently, the pressure of the hydraulic operating fluid can be stabilized in a short time.

FIG. 11 is a waveform diagram illustrating the operation of the first compensation circuit 29. A signal sent from target pressure setting means 25 to a line 26 has a stepped waveform shown in FIG. 11(1). In this case, a waveform of a first deviation led from the first subtraction circuit 34 to a line 28 is shown in FIG. 11 (2). Absolute values of discrimination levels H ϵ1 and Lϵ1 shown in FIG. 11 (2) may be equal to each other. A compensation circuit 51 sends a signal having a waveform shown by the reference numeral 97 in FIG. 11 (3). As shown in a solid line of FIG. 11 (3), a first limiter 50 limits the output of the compensation circuit 51 as shown by the reference numeral 98, and gives the same output to an addition circuit 65.

The level discriminating means 96 serves to discriminate the first deviation led from the first subtraction circuit 34 to the line 28 with the upper and lower discrimination levels Hϵ1 and Lϵ1, and to cut off the switch means 76 when the first deviation is out of a range of Hϵ1 to Lϵ1. After a time T1, the first deviation is kept within the above-mentioned upper and lower discrimination levels Hϵ1 and Lϵ1. Therefore, the first switch means 76 is conducted after the first time ΔT of the first timer means 132 has passed. Accordingly, an integral signal having a waveform shown by the reference numeral 99 in FIG. 11 (4) is obtained from the integral compensation circuit 61. A second limiter 60 limits the output of the integral compensation circuit 61 as shown by the reference numeral 100, and gives, to the addition circuit 65, a signal having a waveform shown in a solid line of FIG. 11 (4). Thus, a signal for pressure control to be performed by an electromagnetic relief valve 6 shown in FIG. 11 (5) is sent to a line 78 by the action of the first compensation circuit 29, an open control circuit 31 and a phase lead compensation circuit 79.

The second compensation circuit 29*a* related to the flow rate of the hydraulic operating fluid of a pump 1 has the same structure as in the above-mentioned first compensation circuit 29, and the same reference numerals having a subscript a attached thereto denote the same portions, correspondingly. The operation of the second compensation circuit 29*a* in a flow rate control state will be summarized below. A signal indicative of a second deviation led from a second subtraction circuit 34*a* to a line 28*a* is sent to a compensation circuit 51*a* having a transfer function Hq1. The output of the compensation circuit 51*a* is given to a limiter 50*a*. When the signal input from the compensation circuit 51*a* exceeds a predetermined range, the limiter 50*a* limits an output to a predetermined range. The output of the first limiter 50*a* is added in an arithmetic circuit 65*a*. The output of the second subtraction circuit 34*a* which is sent through the line 28*a* is also given to a compensation circuit 62*a* having a transfer function Hq2 through second switch means 76*a*. The output of the compensation circuit 62*a* is given to a second limiter 60*a* so that the same limiter operation as described above is performed. The arithmetic circuit 65*a* adds the output of the limiter 60*a* to the output of the limiter 50*a*, and leads the added outputs as a flow rate correction signal to a line 77*a*. The second level discriminating means 96*a* and second timer means 132*a* are provided in order to open and close the second switch means 76*a*. Second level discriminating means 96*a* provided in the second compensation circuit 29*a* performs the following operation. When an absolute value of a second deviation led from the second subtraction circuit 34*a* to the line 28*a* exceeds a predetermined value, that is, the absolute value of the second deviation exceeds 20 litters/min if a target flow rate is set to 300 litters/min, for example, the second deviation gets out of a second range. Consequently, the second level discriminating means 96*a* brings the second switch means 76*a* into an opening state. Accordingly, a signal output from the second subtraction circuit 34*a* is not transmitted to a second integral compensation circuit 61*a*. On the other hand, if a flow rate of a hydraulic operating fluid fed from a pump body 2 is raised so that the second deviation of the second subtraction circuit 34*a* gets into the second range (that is, 280 litters/min<the flow rate of the hydraulic operating fluid<320 litters/min, for example), the second level discriminating means 96*a* generates an operating signal.

When the operating signal is thus generated, the second timer means 132*a* starts timing. After the second timer means 132*a* times a second time, the first switch means 76 is held in a closing state by the operating signal. While the second time may be set equal to the above-mentioned first time, a different time can also be set separately. When the second switch means 76*a* is brought into the closing state, the signal output from the second subtraction circuit 34*a* is transmitted to the compensation circuit 62*a* and the second integral compensation circuit 61*a* through the second switch means 76*a* so that an integral processing is started by the second integral compensation circuit 61*a*.

Thus, if the second timer means 132*a* is provided to delay the start of the integral processing of the second integral compensation circuit 61*a* by the second time, the integral processing by the second integral compensation circuit 61*a* is not performed at the time of the overshoot and the subsequent undershoot if necessary. When the flow rate of the hydraulic operating fluid is somewhat stabilized after great overshoot and subsequent undershoot if necessary, the integral processing is started. Accordingly, an increase in the integral value of the second integral compensation circuit 61*a* can be avoided and the flow rate of the hydraulic operating fluid can be stabilized in a short time.

The third embodiment has been described above.

Next, a fourth embodiment of the present invention will be described with reference to FIGS. 12 and 13. In a control device for a variable displacement pump according to the fourth embodiment, a surge pressure can be prevented from being generated even if a pressure of the hydraulic operating fluid is rapidly raised. Furthermore, a relief flow rate obtained from an electromagnetic relief valve can be controlled with high precision.

Figure 12:
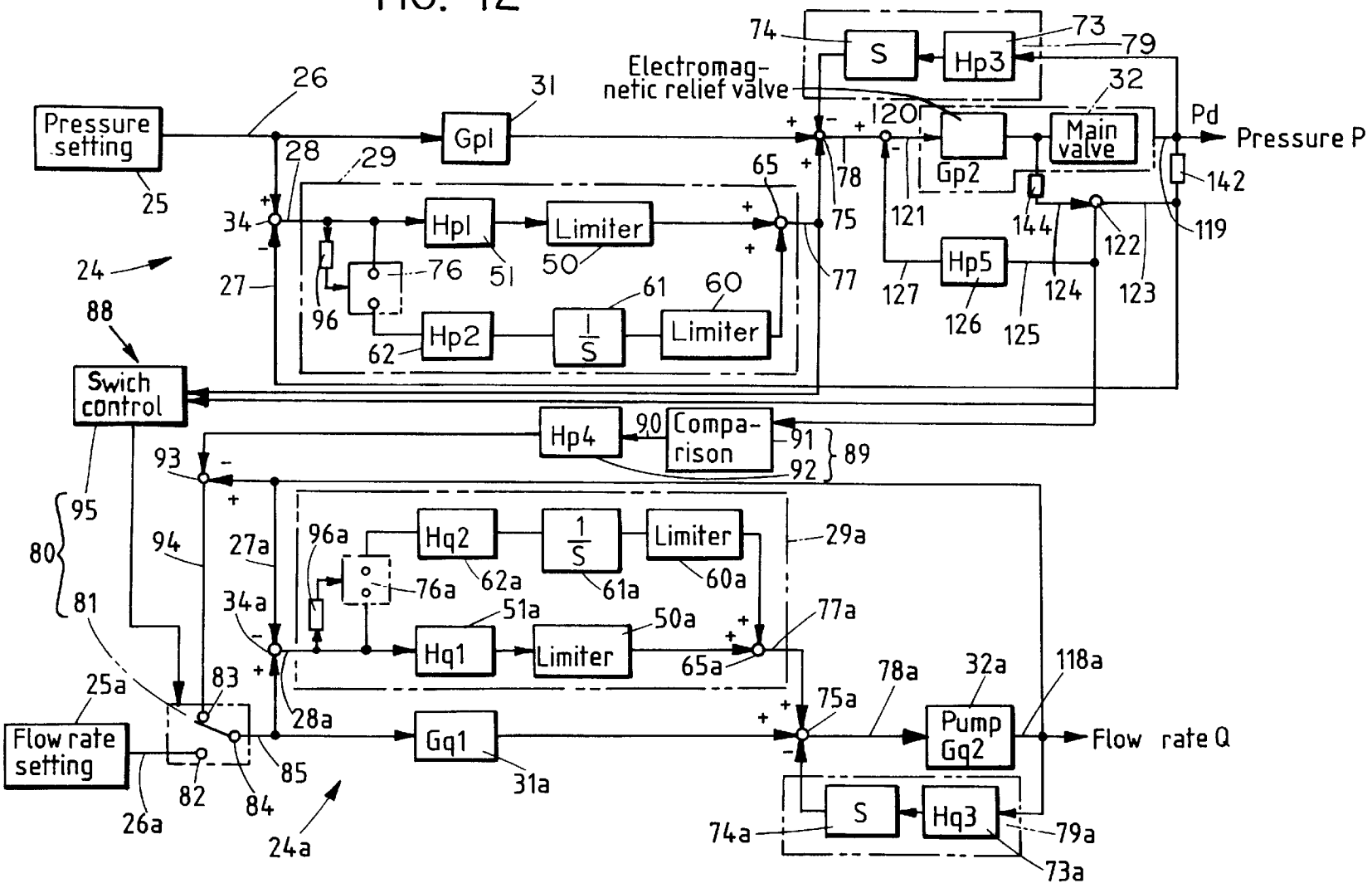
FIG. 12 is a block diagram showing the whole structure of a control device for a variable displacement pump according to a fourth embodiment of the present invention.

FIG. 12 is a block diagram showing the electrical structure of the control device for the variable displacement pump according to the fourth embodiment. The structure according to the fourth embodiment is different from that according to the first embodiment shown in FIG. 1 in the following respects.

More specifically, the fourth embodiment is different from the first embodiment in that a first low-pass filter 142 and a second low-pass filter 144 are provided. A signal indicative of a pressure Pd detected by first pressure detecting means 13 is sent to a differential pressure calculation circuit 122 through the first low-pass filter 142, and a signal indicative of a pressure Pc detected by second pressure detecting means 114 is sent to the differential pressure calculation circuit 122 through the second low-pass filter 144. A signal indicative of a differential pressure (Pd−Pc) which is sent from the differential pressure calculation circuit 122 is transmitted to change-over switch control means 95 as well as a control circuit 126 and a comparison circuit 91. Other structures in the fourth embodiment are the same as those in the first embodiment.

The functions of components according to the fourth embodiment which are particularly different from those of the first embodiment will be described below in detail.

Referring to FIG. 12, the first low-pass filter 142 is provided on a line 119 in the present embodiment. The signal indicative of the pressure Pd detected by the first pressure detecting means 13 is processed by the first low-pass filter 142 so that noise components are removed from the signal indicative of the detected pressure Pd. Furthermore, the second low-pass filter 144 is provided on a line 124. The signal indicative of the pressure Pc detected by the second pressure detecting means 114 is processed by the second low-pass filter 144 so that noise components are removed from the signal indicative of the detected pressure Pc.

In the present embodiment, a cut-off frequency of the first low-pass filter 142 is set to about 50 Hertz (Hz), for example, and a cut-off frequency of the second low-pass filter 144 is set to about 10 Hertz (Hz), for example. Thus, the cut-off frequency of the second low-pass filter 144 is set lower than that of the first low-pass filter 142. By thus setting, the signal indicative of the detected pressure Pc which is sent from the second pressure detecting means 114 to the differential pressure calculation circuit 122 through the second low-pass filter 144 generates a greater time delay than in the signal indicative of the detected pressure Pd which is sent from the first pressure detecting means 13 to the differential pressure calculation circuit 122 through the first low-pass filter 142. Consequently, the difference (Pd−Pc) between the detected pressures which is calculated by the differential pressure calculation circuit 122 approximates to an actual pressure difference. The waveform of the difference (Pd−Pc) between the detected pressures can be obtained to be more similar to that of the actual pressure difference, and the pressure and flow rate of the hydraulic operating fluid can be controlled with higher precision.

An example in which each of the detected pressures Pc and Pd is increased will be specifically described below. There will be described a case where an actual pressure Pc0 of a pipe line 5, an actual pressure Pd0 of a pilot passage 112 and a difference ΔP0=Pd0−Pc0 between the actual pressures Pc0 and Pd0 have values shown in FIG. 13 (1). In this case, the signals themselves sent from the detecting means 13 and 114 have delays and a delay by a digital operation cycle is also generated. Therefore, if the cut-off frequency of the first low-pass filter 142 and that of the second low-pass filter 144 are set equal, for example, to 50 Hz, the detected pressures Pc and Pd have the same time delay so that a difference ΔP=Pd−Pc between the detected pressures Pc and Pd correspondingly generates a time delay as shown in FIG. 13 (2).

Figure 13A:
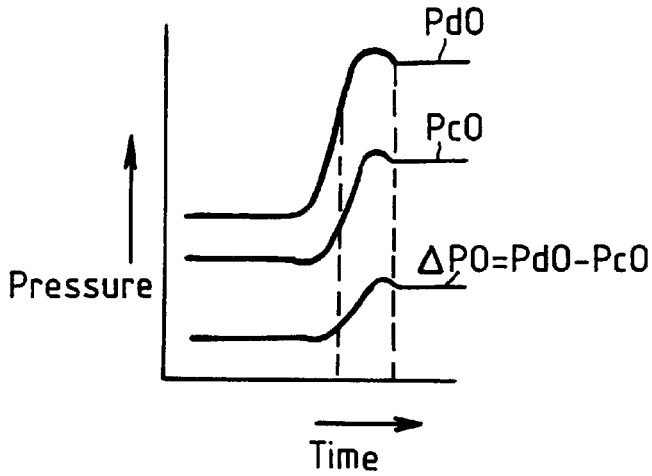
FIGS. 13(A) to 13(C) are graphs showing an actual differential pressure ΔP0 and a detected differential pressure ΔP, (1) showing an actual differential pressure ΔP0, (2) showing a detected differential pressureΔP obtained when each of filters 142 and 144 has the same cut-off frequency, and (3) showing a detected differential pressure ΔP obtained when the filter 144 has a lower cut-off frequency than in the filter 142.
Figure 13B:
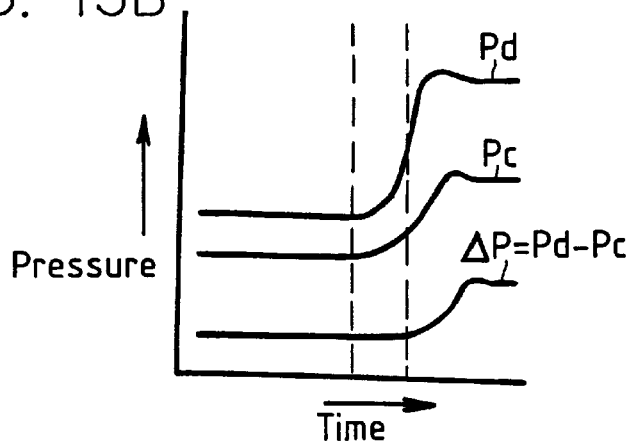
Figure 13C:
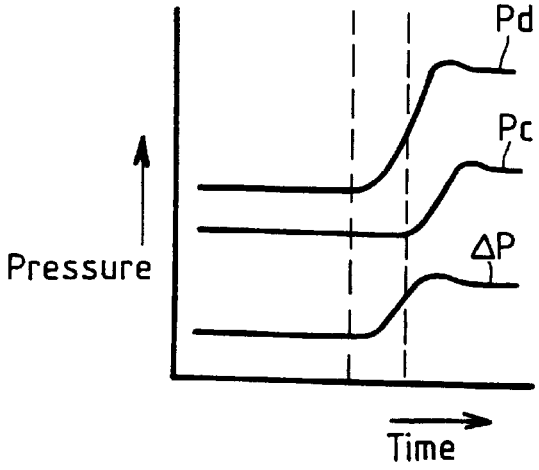

As in the present embodiment, on the other hand, the cut-off frequency (10 Hz) of the second low-pass filter 144 is selected to be lower than the cut-off frequency (50 Hz) of the first low-pass filter 142 so that a greater time delay than in the detected pressure Pd can be generated on the detected pressure Pc as shown in FIG. 13 (3) and the differential pressure ΔP=Pd−Pc can artificially be advanced conversely.

In detail, a first order lag filter is used for the first and second low-pass filters 142 and 144. The first order lag filter is expressed by the following equation.

$$y_n = y_{n-1} + P(x_n - y_{n-1}) \tag{1}$$

Δt: sampling cycle
$y_n$: output value at this time
$x_n$: input value at this time
$y_{n-1}$: output value at the last time
f: cut-off frequency
P and T are expressed by equations (2) and (3).

$$P = \frac{\Delta t}{(\Delta t + T)} \tag{2}$$

$$T = \frac{1}{2\pi f} \text{(time constant)} \tag{3}$$

In the first and second low-pass filters 142 and 144 expressed by the equation (1), if a cut-off frequency f is decreased, a time constant T is increased so that a coefficient P is decreased and an output $y_n$ is decreased. In other words, a variation in the signal is reduced so that a delay is generated. Consequently, a delay is generated on the detected pressure Pc as described above so that the differential pressure ΔP can artificially be advanced. Accordingly, it is possible to obtain the detected differential pressure ΔP which follows a change with the passage of time that approximates to a change with the passage of time of the actual differential pressure ΔP0. Since the detected pressure Pc is not used as a control value, the generation of the delay does not affect the control.

Next, the operation of input change-over means 80 and peripheral members thereof will be described. The change-over switch control means 95 constituting the input change-over means 80 together with change-over switch means 81 changes over the change-over switch means 81 based on a pressure correction signal sent from a first compensation circuit 29 and a signal indicative of the differential pressure (Pd−Pc) which is sent from the differential pressure calculation circuit 122. More specifically, the change-over switch control means 95 causes a common contact 84 of the change-over switch means 81 to be conducted to a separate contact 83 when the pressure correction signal of the first compensation circuit 29 is negative, that is, the pressure detected by the first pressure detecting means 13 is higher than a target pressure set by target pressure setting means 25 or the differential pressure of the differential pressure calculation circuit 122 is greater than a predetermined value, that is, the difference (Pd−Pc) between the pressure Pd detected by the first pressure detecting means 13 and the pressure Pc detected by the second pressure detecting means 114 is greater than a predetermined value. Accordingly, when the pressure correction signal of the first compensation circuit 29 is negative or the differential pressure of the differential pressure compensation circuit 122 is greater than the predetermined value, the change-over switch means 81 is held in a first state in which the common contact 84 and the separate contact 83 are conducted and the output of an arithmetic circuit 93 is given, through the line 85, as an input signal which indicates the target flow rate of the second compensation circuit 29*a*. At this time, accordingly, the control device is brought into a pressure control state so that pressure control is performed in such a manner that the pressure detected by the first pressure detecting means 13 reaches the target pressure set by the target pressure setting means 25, and the flow rate of the pump is controlled so that the relief flow rate of the hydraulic operating fluid is fully reduced. Thus, even if the detected pressure doesn't reach the target pressure, the control device is brought into a pressure control state to reduce the flow rate from the pump when the differential pressure is greater than the predetermined value. Therefore, in a case where the piston of the actuator is located at the stroke end and the load pressure is rapidly raised, a high surge pressure can be prevented from being generated.

On the other hand, when the pressure correction signal of the first compensation circuit 29 is positive and the differential pressure of the differential pressure calculation circuit 122 is smaller than the predetermined value, the change-over switch control means 95 is held in a second state in which the common contact 84 of the change-over switch means 81 is conducted to a separate contact 82. Consequently, a signal indicative of a target flow rate which is sent from target flow rate setting means 25*a* is transmitted as an input signal of a second compensation circuit 29*a* through lines 26*a* and 85. Thus, the control device is brought into a flow rate control state.

While the control device for the variable displacement pump according to a variety of embodiments of the present invention has been described above, the present invention is not restricted to these embodiments but various changes and modifications can be performed without departing from the scope of the present invention.

For example, although the integral processings to be performed by both the first integral compensation circuit in the first compensation circuit related to the pressure control of the hydraulic operating fluid fed from the variable displacement pump and the second integral compensation circuit in the second compensation circuit related to the flow rate control of the same hydraulic operating fluid have been somewhat delayed in the third embodiment, desirable effects can also be obtained by delaying one of the integral processings performed by the first and second integral compensation circuits.

For example, although the fourth embodiment employs both the structure in which the change-over switch means 81 is changed over by utilizing the pressure correction signal sent from a first compensation circuit 92 and the differential pressure signal sent from the differential pressure calculation circuit 122 and the structure in which the first and second low-pass filters 142 and 144 are provided in relation to the first and second pressure detecting means 13 and 114, desirable effects can be obtained by employing either of the structures.

What is claimed is:

1. A control device for a variable displacement pump for controlling a pressure of a hydraulic operating fluid fed from the variable displacement pump, said variable displacement pump capable of varying a flow rate of the discharged hydraulic operating fluid by changing a variable element, the control device comprising:

an electromagnetic relief valve coupled to said variable displacement pump for relieving the pressure of said hydraulic operating fluid, said electromagnetic relief valve having a pilot pressure;

a first negative feedback circuit for controlling the pressure of the hydraulic operating fluid fed from the variable displacement pump, the first negative feedback circuit having first pressure detecting means for detecting the pressure of the hydraulic operating fluid fed from the variable displacement pump, second pressure detecting means for detecting said pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in response to an output of the first subtraction circuit in such a manner that the first deviation reaches zero, thereby controlling the electromagnetic relief valve for relieving the pressure of said hydraulic operating fluid;

a second negative feedback circuit having flow rate detecting means for detecting the flow rate of the hydraulic operating fluid fed from the variable displacement pump, a second subtraction circuit for calculating a second deviation of a signal indicative of the detected flow rate which is sent from the flow rate detecting means from an input signal, and a second compensation circuit for changing the variable element in response to an output of the second subtraction circuit in such a manner that the second deviation obtained by the second subtraction circuit reaches zero;

target flow rate setting means for setting a target flow rate of the hydraulic operating fluid fed from the variable displacement pump; and change-over control means for calculating a signal indicative of the differential pressure which is sent from the differential pressure calculation circuit and the signal indicative of the detected flow rate which is sent from the flow rate detecting means when the pressure detected by the first pressure detecting means is higher than the target pressure set by the target pressure setting means, thereby giving the calculated signals to the second subtraction circuit in such a manner that a relief flow rate of the hydraulic operating fluid is reduced, and for giving, to the second subtraction circuit, a signal indicative of the target flow rate which is sent from the target flow rate setting means when the pressure detected by the first pressure detecting means is lower than the target pressure set by the target pressure setting means.

2. The control device for a variable displacement pump according to claim 1, further comprising an arithmetic circuit for calculating a signal indicative of the target pressure which is sent from the target pressure setting means, the pressure correction signal which is sent from the first compensation circuit and the signal indicative of the differential pressure which is sent from the differential pressure calculation circuit.

3. A control device for a hydraulic operating fluid which controls a pressure of the hydraulic operating fluid fed from a pump, comprising:

an electromagnetic relief valve coupled to said pump for relieving the pressure of said hydraulic operating fluid, said electromagnetic relief valve having a pilot pressure;

a first pressure detecting means for detecting the pressure of the hydraulic operating fluid;

second pressure detecting means for detecting said pilot pressure of the electromagnetic relief valve; and a differential pressure calculation circuit for calculating a difference between the pressures detected by the first and second pressure detecting means, a current to be supplied to the electromagnetic relief valve being controlled by using, as one parameter, the difference in the detected pressure which is obtained by the differential pressure calculation circuit so that a relief pressure of the electromagnetic relief valve is controlled.

4. A control device for a variable displacement pump for controlling a pressure of a hydraulic operating fluid fed from the variable displacement pump, said variable displacement pump capable of varying a flow rate of the discharged hydraulic operating fluid by changing a variable element, the control device comprising:

an electromagnetic relief valve coupled to said variable displacement pump for relieving the pressure of said hydraulic operating fluid, said electromagnetic relief valve having a pilot pressure;

first pressure detecting means for detecting the pressure of the hydraulic operating fluid fed from the variable displacement pump, second pressure detecting means for detecting said pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, command pressure setting means for setting a target command pressure in relation to the target pressure set by the target pressure setting means, a subtraction circuit for calculating a deviation of a signal indicative of the detected pressure which is sent from the first pressure detecting means from the target command pressure set by the command pressure setting means, and a compensation circuit for calculating a pressure correction signal in such a manner that the deviation reaches zero, thereby controlling the electromagnetic relief valve for relieving the pressure of said hydraulic operating fluid;

the command pressure setting means setting the target command pressure based on the pressure detected by the first pressure detecting means, setting, as the target command pressure, a first command pressure which is lower than the target pressure set by the target pressure setting means when the pressure detected by the first pressure detecting means is equal to or lower than a first predetermined pressure which is lower than the target pressure, and setting the target pressure as the target command pressure when the pressure detected by the first pressure detecting means is equal to the target pressure.

5. The control device for a variable displacement pump according to claim 4, wherein the command pressure setting means sets the first command pressure as the target command pressure when the pressure detected by the first pressure detecting means is equal to or lower than a first predetermined pressure which is lower than the target pressure, sets the target pressure as the target command pressure when the pressure detected by the first pressure detecting means is equal to the target pressure, and gradually increases the target command pressure to be set as the pressure detected by the first pressure detecting means is raised when the pressure detected by the first pressure detecting means is higher than the first predetermined pressure and is lower than the target pressure.

6. The control device for a variable displacement pump according to claim 4, wherein the command pressure setting means sets the target pressure as the target command pressure when the pressure detected by the first pressure detecting means reaches a second predetermined pressure which is higher than the first predetermined pressure and is lower than the target pressure.

7. The control device for a variable displacement pump according to claim 6, wherein the command pressure setting means sets the first command pressure as the target command pressure when the pressure detected by the first pressure detecting means is equal to or lower than the first predetermined pressure which is lower than the target pressure, sets the target pressure as the target command pressure when the pressure detected by the first pressure detecting means is equal to or higher than the second predetermined pressure, and gradually increases the target command pressure to be set as the pressure detected by the first pressure detecting means is raised when the pressure detected by the first pressure detecting means is higher than the first predetermined pressure and is lower than the second predetermined pressure.

8. A control device for a variable displacement pump for controlling a pressure of a hydraulic operating fluid fed from the variable displacement pump, said variable displacement pump capable of varying a flow rate of the discharged hydraulic operating fluid by changing a variable element, the control device comprising:

an electromagnetic relief valve coupled to said variable displacement pump for relieving the pressure of said hydraulic operating fluid, said electromagnetic relief valve having a pilot pressure;

first pressure detecting means for detecting the pressure of the hydraulic operating fluid fed from the variable displacement pump, second pressure detecting means for detecting said pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a subtraction circuit for calculating a deviation of a signal indicative of the detected pressure which is sent from the first pressure detecting means from the target pressure set by the target pressure setting means, and a compensation circuit for calculating a pressure correction signal in relation to an output of the subtraction circuit in such a manner that the deviation reaches zero, thereby controlling the electromagnetic relief valve, the compensation circuit having an integral compensation circuit for performing an integral processing for a signal output from the subtraction circuit, and switch means for transmitting the signal output from the subtraction circuit to the integral compensation circuit and stopping the transmission, the switch means serving to transmit the output signal from the subtraction circuit to the integral compensation circuit after a predetermined time has passed since the signal output form the subtraction circuit got into a predetermined range, thereby starting the integral processing of the integral compensation circuit.

9. A control device for a variable displacement pump for controlling a pressure of a hydraulic operating fluid fed from the variable displacement pump, said variable displacement pump capable of varying a flow rate of the discharged hydraulic operating fluid by changing a variable element, the control device comprising:

an electromagnetic relief valve coupled to said variable displacement pump for relieving the pressure of said hydraulic operating fluid, said electromagnetic relief valve having a pilot pressure;

a first negative feedback circuit for controlling the pressure of the hydraulic operating fluid fed from the variable displacement pump, the first negative feedback circuit having first pressure detecting means for detecting the pressure of the hydraulic operating fluid fed from the variable displacement pump, second pressure detecting means for detecting said pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in relation to an output of the first subtraction circuit in such a manner that the first deviation reaches zero, thereby controlling the electromagnetic relief valve;

a second negative feedback circuit for controlling the flow rate of the hydraulic operating fluid fed from the variable displacement pump, the second negative feedback circuit having flow rate detecting means for detecting the flow rate of the hydraulic operating fluid fed from the variable displacement pump, a second subtraction circuit for calculating a second deviation of a signal indicative of the detected flow rate which is sent from the flow rate detecting means from an input signal, and a second compensation circuit for changing the variable element in relation to an output of the second subtraction circuit in such a manner that the second deviation reaches zero;

target flow rate setting means for setting a target flow rate of the hydraulic operating fluid fed from the variable displacement pump; and change-over control means for changing over a signal input to the second subtraction circuit;

the change-over control means calculating a signal indicative of the differential pressure which is sent from the differential pressure calculation circuit and the signal indicative of the detected flow rate which is sent from the flow rate detecting means when a difference between the pressure detected by the first pressure detecting means and the target pressure is greater than a predetermined value, thereby giving the calculated output signals as the input signal to the second subtraction circuit in such a manner that a relief flow rate of the hydraulic operating fluid is reduced, and giving, as the input signal, a signal indicative of the target flow rate which is sent from the target flow rate setting means to the second subtraction circuit when the difference between the pressure detected by the first pressure detecting means and the target pressure is equal to or smaller than the predetermined value, the first compensation circuit having a first integral compensation circuit for performing an integral processing for a signal output from the first subtraction circuit, and first switch means for transmitting the signal output from the first subtraction circuit to the first integral compensation circuit and stopping the transmission, the first switch means serving to transmit the output signal from the first subtraction to the first integral compensation circuit after a first time has passed since the signal output from the first subtraction circuit got into a first range, thereby starting the integral processing of the first integral compensation circuit.

10. The control device for a variable displacement pump according to claim 9, wherein the second compensation circuit has a second integral compensation circuit for performing an integral processing for a signal output from the second subtraction circuit, and second switch means for transmitting the signal output from the second subtraction circuit to the second integral compensation circuit and stopping the transmission, the second switch means serving to transmit the output signal from the second subtraction circuit to the second integral compensation circuit after a second time has passed since the signal output from the second subtraction circuit got into a second range, thereby starting the integral processing of the second integral compensation circuit.

11. The control device for a variable displacement pump according to claim 10, wherein first and second timer means are provided in relation to the first and second switch means of the first and second compensation circuits, the first timer means starting timing when the signal output from the first subtraction circuit gets into the first range, the integral processing of the first integral compensation circuit being started when the first timer means times the first time, the second timer means starting timing when the signal output from the second subtraction circuit gets into the second range, and the integral processing of the second integral compensation circuit being started when the second timer means times the second time.

12. A control device for a variable displacement pump for controlling a pressure of a hydraulic operating fluid fed from the variable displacement pump, said variable displacement pump capable of varying a flow rate of the discharged hydraulic operating fluid by changing a variable element, the control device comprising:

an electromagnetic relief valve coupled to said variable displacement pump for relieving the pressure of said hydraulic operating fluid, said electromagnetic relief valve having a pilot pressure;

a first negative feedback circuit for controlling the pressure of the hydraulic operating fluid fed from the variable displacement pump, the first negative feedback circuit having first pressure detecting means for detecting the pressure of the hydraulic operating fluid fed from the variable displacement pump, second pressure detecting means for detecting said pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in relation to an output of the first subtraction circuit in such a manner that the first deviation reaches zero, thereby controlling the electromagnetic relief valve;

a second negative feedback circuit for controlling the flow rate of the hydraulic operating fluid fed from the variable displacement pump, the second negative feedback circuit having flow rate detecting means for detecting the flow rate of the hydraulic operating fluid fed from the variable displacement pump, a second subtraction circuit for calculating a second deviation of a signal indicative of the detected flow rate which is sent from the flow rate detecting means for an input signal, and a second compensation circuit for changing the variable element in relation to an output of the second subtraction circuit in such a manner that the second deviation reaches zero;

target flow rate setting means for setting a target flow rate of the hydraulic operating fluid fed from the variable displacement pump; and change-over control means for changing over a signal input to the second subtraction circuit;

the change-over control means calculating a signal indicative of the differential pressure which is sent from the differential pressure calculation circuit and the signal indicative of the detected flow rate which is sent from the flow rate detecting means when a difference between the pressure detected by the first pressure detecting means and the target pressure is greater than a predetermined value, thereby giving the calculated output signals as the input signal to the second subtraction circuit in such a manner that a relief flow rate of the hydraulic operating fluid is reduced, and giving, as the input signal, the signal indicative of the target flow rate which is sent from the target flow rate setting means to the second subtraction circuit when the difference between the pressure detected by the first pressure detecting means and the target pressure is equal to or smaller than the predetermined value;

the second compensation circuit having an integral compensation circuit for performing an integral processing for a signal output from the second subtraction circuit, and switch means for transmitting the signal output from the second subtraction circuit to the integral compensation circuit and stopping the transmission, the switch means serving to transmit the output signal from the second subtraction circuit to the integral compensation circuit after a predetermined time has passed since the signal output from the second subtraction circuit got into a predetermined range, thereby starting the integral processing of the integral compensation circuit.

13. A control device for a variable displacement pump for controlling a pressure of a hydraulic operating fluid fed from the variable displacement pump, said variable displacement pump capable of varying a flow rate of the discharged hydraulic operating fluid by changing a variable element, the control device comprising:

an electromagnetic relief valve coupled to said variable displacement pump for relieving the pressure of said hydraulic operating fluid, said electromagnetic relief valve having a pilot pressure;

a first negative feedback circuit for controlling the pressure of the hydraulic operating fluid fed from the variable displacement pump, the first negative feedback circuit having first pressure detecting means for detecting the pressure of the hydraulic operating fluid fed from the variable displacement pump, second pressure detecting means for detecting said pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in response to an output of the first subtraction circuit in such a manner that the first deviation reaches zero, thereby controlling the electromagnetic relief valve;

a second negative feedback circuit having flow rate detecting means for detecting the flow rate of the hydraulic operating fluid fed from the variable displacement pump, a second subtraction circuit for calculating a second deviation of a signal indicative of the detected flow rate which is sent from the flow rate detecting means from an input signal, and a second compensation circuit for changing the variable element in response to an output of the second subtraction circuit in such a manner that the second deviation obtained by the second subtraction circuit reaches zero;

target flow rate setting means for setting a target flow rate of the hydraulic operating fluid fed from the variable displacement pump;

change-over switch means for selectively changing over into a first state in which an operating value of a signal indicative of the differential pressure which is sent from the differential pressure calculation circuit and the signal indicative of the detected flow rate which is sent from the flow rate detecting means is given to the second subtraction circuit and a second state in which a signal indicative of the target flow rate which is sent from the target flow rate setting means is given to the second subtraction circuit; and change-over switch control means for holding the change-over switch means in the first state to reduce a relief flow rate of the hydraulic operating fluid when the pressure detected by the first pressure detecting means is higher than the target pressure set by the target pressure setting means or the differential pressure signal sent from the differential pressure calculation circuit is greater than a predetermined value, and for holding the change-over switch means in the second state when the pressure detected by the first pressure detecting means is lower than the target pressure set by the target pressure set by the target pressure setting means and the differential pressure signal sent from the differential pressure calculation circuit is smaller than the predetermined value.

14. The control device for a variable displacement pump according to claim 13, further comprising a first low-pass filter for processing the signal indicative of the detected pressure which is sent from the first pressure detecting means and a second low-pass filter for processing a signal indicative of the detected pressure which is sent from the second pressure detecting means, a cut-off frequency of the second low-pass filter being set lower than that of the first low-pass filter.

15. A control device for a variable displacement pump for controlling a pressure of a hydraulic operating fluid fed from the variable displacement pump, said variable displacement pump capable of varying a flow rate of the discharged hydraulic operating fluid by changing a variable element, the control device comprising:

an electromagnetic relief valve coupled to said variable displacement pump for relieving the pressure of said hydraulic operating fluid, said electromagnetic relief valve having a pilot pressure;

a negative feedback circuit for controlling the pressure of the hydraulic operating fluid fed from the variable displacement pump in a pressure control state in which the pressure of the hydraulic operating fluid is to be controlled, the negative feedback circuit having first pressure detecting means for detecting the pressure of the hydraulic operating fluid fed from the variable displacement pump, second pressure detecting means for detecting said pilot pressure of the electromagnetic relief valve, a differential pressure calculation circuit for calculating a difference between the pressures detected by the first and second pressure detecting means, target pressure setting means for setting a target pressure of the hydraulic operating fluid fed from the variable displacement pump, a first subtraction circuit for calculating a first deviation of a signal indicative of the detected pressure which is sent from the first pressure detecting means from the target pressure set by the target pressure setting means, and a first compensation circuit for calculating a pressure correction signal in response to an output of the first subtraction circuit in such a manner that the first deviation reaches zero, thereby controlling the electromagnetic relief valve;

the control device further comprising:

a first low-pass filter for processing the signal indicative of the detected pressure which is sent from the first pressure detecting means and a second low-pass filter for processing a signal indicative of the detected pressure which is sent from the second pressure detecting means, a cut-off frequency of the second low-pass filter being set lower than that of the first low-pass filter.

* * * * *